US005745650A

United States Patent [19]

Otsuka et al.

[11] Patent Number: 5,745,650

[45] Date of Patent: Apr. 28, 1998

[54] SPEECH SYNTHESIS APPARATUS AND METHOD FOR SYNTHESIZING SPEECH FROM A CHARACTER SERIES COMPRISING A TEXT AND PITCH INFORMATION

[75] Inventors: Mitsuru Otsuka; Yasunori Ohora; Takashi Aso; Toshiaki Fukada, all of Yokohama, Japan

[73] Assignee: Canon Kabushiki Kaisha, Tokyo, Japan

[21] Appl. No.: 448,982

[22] Filed: May 24, 1995

[30] Foreign Application Priority Data

May 30, 1994 [JP] Japan ..... 6-116720

[51] Int. Cl.[6] ..... G10L 9/04

[52] U.S. Cl. ..... 395/2.69; 395/2.1; 395/2.14; 395/2.15; 395/2.16; 395/2.2; 395/2.67; 395/2.73; 395/2.76; 395/2.77

[58] Field of Search ..... 395/2.09, 2.1, 395/2.14–2.16, 2.2, 2.25, 2.26, 2.67, 2.73, 2.76, 2.77, 2.69, 2.44, 2.5

[56] References Cited

U.S. PATENT DOCUMENTS

| | | | |
|---|---|---|---|
| 4,384,169 | 5/1983 | Mozer et al. | 395/2.15 |
| 4,937,868 | 6/1990 | Taguchi . | |
| 5,048,088 | 9/1991 | Taguchi . | |
| 5,220,629 | 6/1993 | Kosaka et al. . | |
| 5,381,514 | 1/1995 | Aso et al. . | |
| 5,485,543 | 1/1996 | Aso | 395/2.76 |

FOREIGN PATENT DOCUMENTS

| | | | |
|---|---|---|---|
| 139419 A1 | 2/1985 | European Pat. Off. | 395/2.1 |
| 0 388 104 | 9/1990 | European Pat. Off. . | |
| 0 685 834 | 6/1995 | European Pat. Off. . | |

OTHER PUBLICATIONS

Hashimoto, Kenji et al., "High Quality Synthetic Speech Generation Using Synchronized Oscillators", IEICE Transactions on Fundamentals of Electronics, Communications and Computer Sciences, vol. 76A, No. 11, Nov. 1, 1993, pp. 1949–1955.

*Primary Examiner*—Allen R. MacDonald
*Assistant Examiner*—Alphonso A. Collins
*Attorney, Agent, or Firm*—Fitzpatrick, Cella, Harper & Scinto

[57] ABSTRACT

A speech synthesis method and apparatus for synthesizing speech from a character series comprising a text and pitch information. The apparatus includes a parameter generator for generating power spectrum envelopes as parameters of a speech waveform to be synthesized representing the input text in accordance with the input character series. The apparatus also includes a pitch waveform generator for generating pitch waveforms whose period equals the pitch specified by the pitch information. The pitch waveform generator generates the pitch waveforms from the input pitch information and the power spectrum envelopes generated by the parameter generator. Also provided is a speech waveform output device for outputting the speech waveform obtained by connecting the generated pitch waveforms.

26 Claims, 25 Drawing Sheets

LOGARITHMIC POWER SPECTRUM ENVELOPE a (n)

$a(n)=A(2\pi n/N)$

IMPULSE RESPONSE h(n)

SYNTHESIS PARAMETER p(m)

$p(0)=r\cdot h(0)$ $p(m)=2r\cdot h(m)$ $(r\neq 0,\ 0<m<M)$

FIG.8

DATA STRUCTURE OF ONE FRAME OF PARAMETER

| | |
|---|---|
| K | SPEECH SPEED COEFFICIENT |
| s | PITCH SCALE |
| p[0]~p[M-1] | SYNTHESIS PARAMETER |

FIG.16

DATA STRUCTURE OF ONE FRAME OF PARAMETER

| | |
|---|---|
| K | SPEECH SPEED COEFFICIENT |
| uvflag | VOICED/VOICELESS INFORMATION |
| s | PITCH SCALE |
| p[0]~p[M-1] | SYNTHESIS PARAMETER |

LOGARITHMIC POWER SPECTRUM ENVELOP a(n)

$a(n)=A(2\pi n/N)$

IMPULSE RESPONSE h(m)

IMPULSE RESPONSE WAVEFORM USED FOR GENERATING PITCH WAVEFORM h'(m)

$h'(0)=r\cdot h(0)$
$h'(m)=2r\cdot h(m)$ $(r\neq 0,\ 1\leq m<M)$

SYNTHESIS PARAMETER $p(n)=r\cdot\exp(a(n))$ $(r\neq 0,\ 0\leq n<N)$

FIG.19

DATA STRUCTURE OF ONE FRAME OF PARAMETER

| | |
|---|---|
| K | SPEECH SPEED COEFFICIENT |
| s | PITCH SCALE |
| p[0]~p[N-1] | SYNTHESIS PARAMETER |

SPEECH SYNTHESIS APPARATUS AND METHOD FOR SYNTHESIZING SPEECH FROM A CHARACTER SERIES COMPRISING A TEXT AND PITCH INFORMATION

BACKGROUND OF THE INVENTION

1. Field of the Invention

This invention relates to a speech synthesis method and apparatus according a rule-based synthesis approach. More particularly, the invention relates to a speech synthesis method and apparatus for outputting synthesized speech having excellent tone quality while reducing the number of calculations for generating pitch waveforms of the synthesized speech.

2. Description of the Related Art

In convetional rule-based speech synthesis apparatuses, synthesized speech is generated, for example, by a synthesis filter method (PARCOR (partial autocorrelation), LSP (line spectrum pair) or MLSA (mel log spectrum approximation), a waveform coding method, or an impulse-response-waveform overlapping method.

However, the above-described conventional methods have the following problems. That is, in the synthesis filter method, a large amount of calculations is required for generating a speech waveform. In the waveform coding method, complicated waveform coding processing is required for performing adjustment to the pitch of synthesized speech, whereby the tone quality of the synthesized speech is degraded. In the impulse-response-waveform overlapping method, the tone quality is degraded at portions where waveforms overlap each other.

In the above-described conventional methods, it is difficult to perform processing for generating a speech waveform having a pitch period which is not an integer multiple of a sampling period, so that synthesized speech having an exact pitch cannot be obtained.

In the above-described conventional methods, parameters cannot be operated in the frequency domain, so that the operator must perform an operation which is difficult to understand.

The frequency domain is the domain in which a spectrum of a waveform is defined. Parameters in the above-described conventional methods are not defined in the frequency domain. So, an operation of changing values of the parameters cannot be performed there. In order to change a tone of speech sound, the operation of changing a spectrum of a speech waveform is easy to understand sensuously. Compared with it, the operation of changing values of parameters in the above-described conventional methods is difficult for the operator to understand.

In the above-described conventional methods, increasing and decreasing of the sampling frequency and low-pass filter processing must be performed, thereby causing complicated processing and a large number of calculations.

In the above-described conventional methods, in order to change the tone of synthesized speech, speech parameters must be changed, thereby causing very complicated processing.

In the above-described conventional methods, all waveforms of synthesized speech must be generated by one of the synthesis filter method, the waveform coding method and the impulse-response-waveform overlapping method, thereby requiring a large number of calculations.

SUMMARY OF THE INVENTION

The present invention has been made in consideration of the above-described problems.

It is an object of the present invention to provide a speech synthesis method and apparatus which prevents degradation in the tone quality of synthesized speech, and reduces the number of calculations required for generating a speech waveform.

It is another object of the present invention to provide a speech synthesis method and apparatus for obtaining synthesized speech having an exact pitch.

It is still another object of the present invention to provide a speech synthesis method and apparatus for reducing the number of calculations required for conversion of a sampling frequency of synthesized speech.

According to one aspect, the present invention which achieves at least one of these objectives relates to a speech synthesis apparatus for synthesizing speech from a character series comprising a text and pitch information input into the apparatus. The apparatus comprises parameter generation means for generating power spectrum envelopes as parameters of a speech waveform to be synthesized representing the input text in accordance with the input character series. The apparatus also comprises pitch waveform generation means for generating pitch waveforms whose period equals the pitch period specified by the input pitch information. The pitch waveform generation means generates the pitch waveforms from the input pitch information and the power spectrum envelopes generated as the parameters of the speech waveform by the parameter generation means. The apparatus further comprises speech waveform output means for outputting the speech waveform obtained by connecting the generated pitch waveforms.

The pitch waveform generation means can comprise matrix derivation means for deriving a matrix for converting the power spectrum envelopes into the pitch waveforms. In this embodiment, the pitch waveform generation means generates the pitch waveforms by obtaining a product of the derived matrix and the power spectrum envelopes.

The text can comprise a phonetic text. Moreover, the apparatus is adapted to receive speech information comprising the character series, the character series comprising the phonetic text represented by the speech waveform and control data. The control data includes pitch information and specifies characteristics of the speech waveform. The apparatus further comprises means for identifying when the phonetic text and the control data are input as the speech information. In addition, the parameter generation means generates the parameters in accordance with the speech information identified by the identification means.

The apparatus can further comprise a speaker for outputting a speech waveform output from the speech waveform output means as synthesized speech. In addition, the apparatus further comprises a keyboard for inputting the character series.

According to another aspect, the present invention which achieves at least one of these objectives relates to a speech synthesis apparatus for synthesizing speech from a character series comprising a text and pitch information input into the apparatus. The apparatus comprises parameter generation means, pitch waveform generation means and speech waveform output means. The parameter generation means generates power spectrum envelopes as parameters of a speech waveform to be synthesized representing the input text in accordance with the input character series. The pitch waveform generation means generates pitch waveforms from a sum of products of the parameters a cosine series, whose coefficients relate to the input pitch information and sampled values of the power sepctrum envelopes generated as the parameters. The speech waveform output means outputs the speech waveform obtained by connecting the generated pitch waveforms.

The pitch waveform generation means generates pitch waveforms whose period equals the pitch period of the speech waveform output by the speech waveform output means. In addition, the pitch waveform generation means calculates the sum of the products while shifting the phase of the cosine series by half a period.

The pitch waveform generation means in this embodiment can further comprise matrix derivation means for deriving a matrix for each pitch by computing a sum of products of cosine functions, whose coefficients comprise impulse-response waveforms obtained from logarithmic power spectrum envelopes of the speech to be synthesized, and cosine functions, whose coefficients comprise sampled values of the power spectrum envelopes. The pitch waveform generation means generates the pitch waveforms by obtaining the product of the derived matrix and the impulse-response waveforms.

According to another aspect, the present invention which achieves at least one of these objectives relates to a speech synthesis method for synthesizing speech from a character series comprising a text and pitch information. The method comprises the step of generating power spectrum envelopes as parameters of a speech waveform to be synthesized representing the text in accordance with the character series. The method further comprises the step of generating pitch waveforms, whose period equals the pitch period specified by the pitch information, from the input pitch information and the power spectrum envelopes generated as the parameters in the power spectrum envelope generating step. The method further comprises the step of connecting the generated pitch waveforms to produce the speech waveform.

The method further comprises the steps of deriving a matrix for converting the power spectrum envelopes into pitch waveforms and generating the pitch waveforms by obtaining a product of the derived matrix and the power spectrum envelopes.

The text can comprise a phonetic text and the character series can comprise the phonetic text, represented by the speech waveform, and control data. The control data includes the pitch information and specifies the characteristics of the speech waveform. The method further comprises the steps of identifying when the phonetic text and the control data are input as part of the character series and generating the parameters in accordance with the identification. The method can further comprise the step of outputting the connected pitch waveforms from a speaker as synthesized speech and inputting the character series from a keyboard to a speech synthesis apparatus.

According to still another aspect, the present invention which achieves at least one of these objectives relates to a speech synthesis method for synthesizing speech from a character series comprising a text and pitch information. The method comprises the step of generating power spectrum envelopes as parameters of a speech waveform to be synthesized and representing the text in accordance with the input character series. The method further comprises the step of generating pitch waveforms from a sum of products of the parameters and a cosine series, whose coefficients relate to the pitch information and sampled values of the power sepctrum envelopes generated as the parameters. The method further comprises the step of connecting the generated pitch waveforms to produce the speech waveform.

The pitch waveform generating step can comprise the step of generating pitch waveforms having a period equal to the period of the speech waveform produced in the connecting step. In addition, the pitch waveform generating step can calculate the sum of the products while shifting the phase of the cosine series by half a period.

The method can also comprise the steps of obtaining impulse-response waveforms from logarithmic power spectrum envelopes of the speech to be synthesized, deriving a matrix by computing a sum of products of a cosine function, whose coefficients comprise the impulse-response waveforms and a cosine function whose coefficients comprise sampled values of the power spectrum envelopes, and generating the pitch waveforms by calculating a product of the matrix and the impulse-response waveforms.

The present invention prevents degradation in the tone quality of synthesized speech by generating pitch waveforms and unvoiced waveforms from pitch information and the parameters, and connecting the pitch waveforms and the unvoiced waveforms to produce a speech waveform.

The present invention reduces the amount of calculation required for generating a speech waveform by calculating a product of a matrix, which has been obtained in advance, and parameters in the generation of pitch waveforms and unvoiced waveforms.

The present invention synthesizes speech having an exact pitch by generating and connecting pitch waveforms, whose phases are shifted with respect to each other, in order to represent the decimal portions of the number of pitch period points in the generation of pitch waveforms.

The present invention generates synthesized speech having an arbitrary sampling frequency with a simple method by generating pitch waveforms at the arbitrary sampling frequency using parameters (impulse-response waveforms) obtained at a certain sampling frequency and connecting the pitch waveforms in the generation of pitch waveforms.

The present invention also generates a speech waveform from parameters in a frequency region and operating parameters in a frequency region by generating pitch waveforms from power spectrum envelopes of a speech using the power spectrum envelopes as parameters.

The present invention can also change the tone of synthesized speech without operating parameters, by generating pitch waveforms by providing a function for determining frequency characteristics, converting sampled values of spectrum envelopes obtained from parameters by multiplying them with function values at integer multiples of a pitch frequency, and performing a Fourier transform of the converted sampled values in the generation of pitch waveforms.

The present invention also reduces the amount of calculation required for generating a speech waveform by utilizing the symmetry of waveforms in the generation of pitch waveforms.

The foregoing and other objects, advantages and features of the present invention will become more apparent from the following description of the preferred embodiments taken in conjunction with the accompanying drawings.

BRIEF DESCRIPTION OF THE DRAWINGS

FIG. 8 is a schematic diagram illustrating the data structure of one frame of a parameter;

FIG. 16 is a schematic diagram illustrating the data structure of one frame of a parameter;

FIG. 19 is a schematic diagram illustrating the data structure of one frame of a parameter;

DESCRIPTION OF THE PREFERRED EMBODIMENTS

First Embodiment

Figure 25:
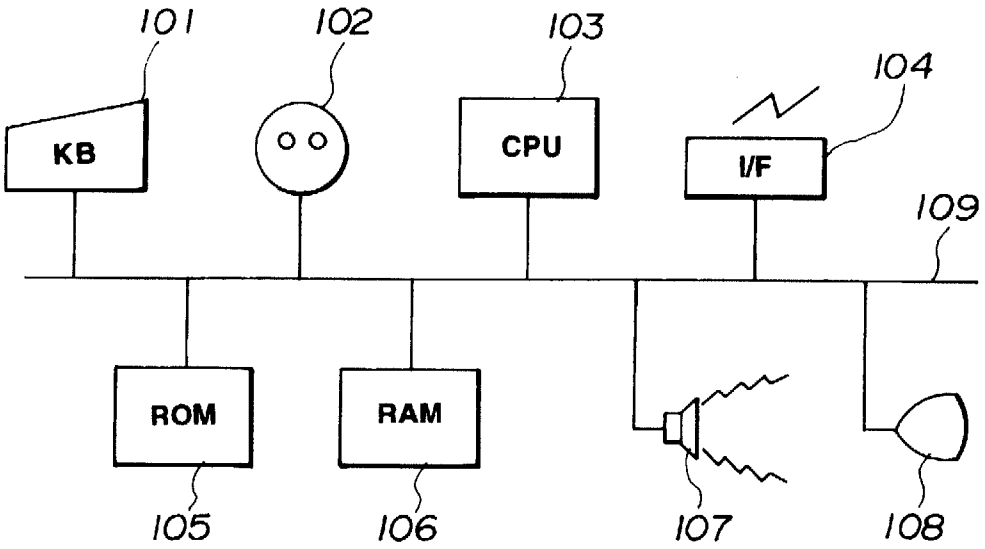
FIG. 25 is a block diagram illustrating the configuration of a speech synthesis apparatus used in the embodiments.

FIG. 25 is a block diagram illustrating the configuration of a speech synthesis apparatus used in preferred embodiments of the present invention.

In FIG. 25, reference numeral 101 represents a keyboard (KB) for inputting text from which speech will be synthesized, a control command or the like. The operator can input a desired position on a display picture surface of a display unit 108 using a pointing device 102. By designating an icon using the pointing device 102, a desired command or the like can be input. A CPU (central processing unit) 103 controls various kinds of processing (to be described later) executed by the apparatus in the embodiments, and executes the processing in accordance with control programs stored in a ROM (read-only memory) 105. A communication interface (I/F) 104 controls data transmission/reception performed utilizing various kinds of communication facilities. The ROM 105 stores control programs for processing performed according to flowcharts shown in the drawings. A random access memory (RAM) 106 is used as means for storing data produced in various kinds of processing performed in the embodiments. A speaker 107 outputs synthesized speech, or speech, such as a message for the operator, or the like. The display unit 108 comprises an LCD (liquid-crystal display), a CRT (cathode-ray tube) display or the like, and displays the text input from the keyboard 101 or data being processed. A bus 109 performs transmission of data, a command or the like between the respective units.

Figure 1:
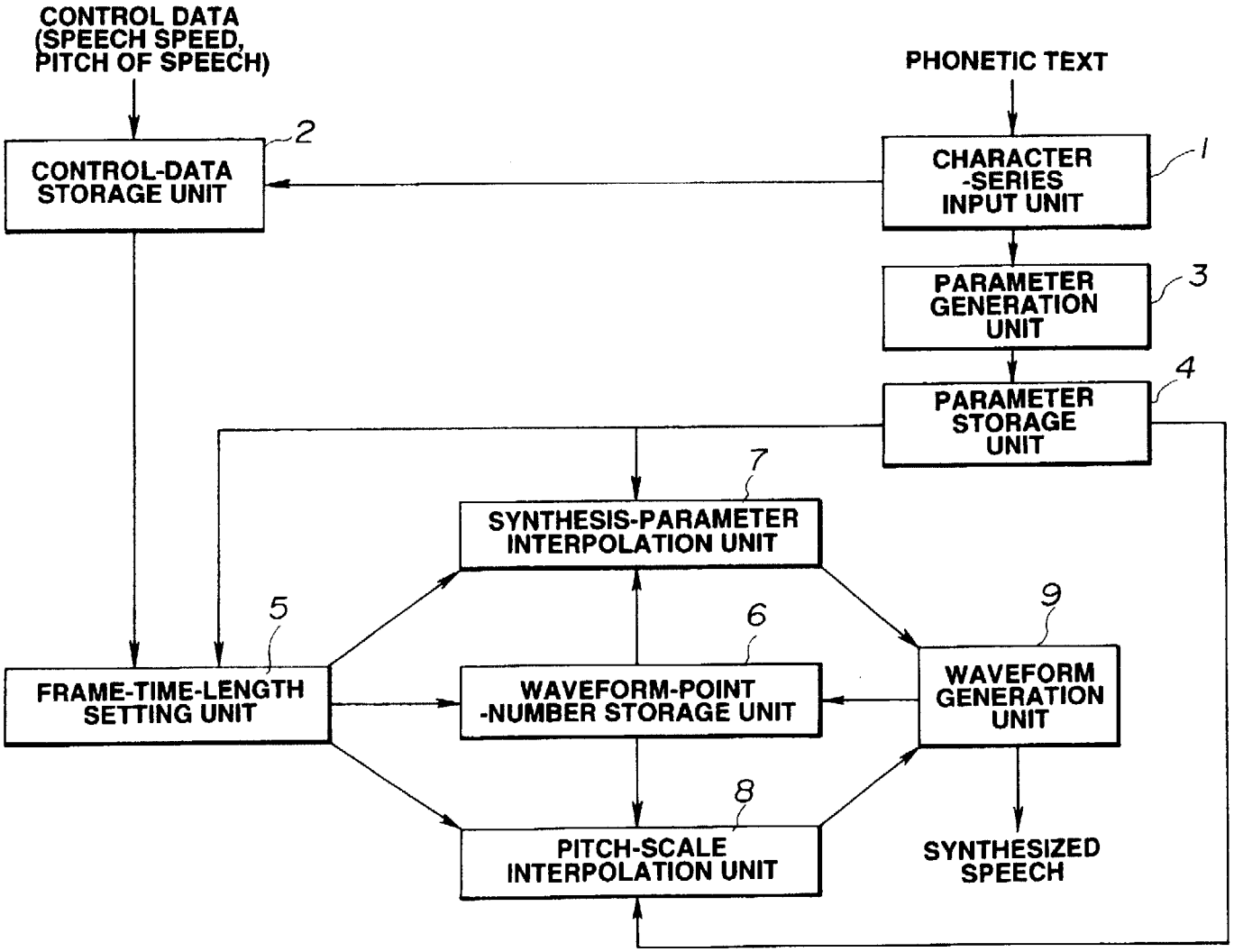
FIG. 1 is a block diagram illustrating the functional configuration of a speech synthesis apparatus used in embodiments of the present invention.

FIG. 1 is a block diagram illustrating the functional configuration of a speech synthesis apparatus according to a first embodiment of the present invention. Respective functions are executed under the control of the CPU 103 shown in FIG. 25. Reference numeral 1 represents a character-series input unit for inputting a character series of speech to be synthesized. For example, if the word to be synthesized is "speech", a character series of a phonetic text, comprising, for example, phonetic signs "spi:t|", is input by unit 1. This character series is either input from the keyboard 101 or read from the RAM 106. A character series input from the character-series input unit 1 includes, in some cases, a character series indicating, for example, a control sequence for setting the speed and the pitch of speech, and the like in addition to a phonetic text. By comparing the input character series with a phonetic-text-code table and a control-sequence-code table, the character-series input unit 1 determines whether the input character series comprises a phonetic text or a control sequence for each code according to the input order, and switches the transmission destination accordingly. A control-data storage unit 2 stores in an internal register a character series, which has been determined to be a control sequence and which has been transmitted by the character-series input unit 1. The unit 2 also stores control data, such as the speed and the pitch of the speech to be synthesized input from a user interface, in an internal register. When the character-series input unit determines that an input character series is a phonetic text, it transmits the character series to a parameter generation unit 3 which reads and generates a parameter series stored in the ROM 105, therefrom in accordance with the input character series. A parameter storage unit 4 extracts parameters of a frame to be processed from the parameter series generated by the parameter generation unit 3, and stores the extracted parameters in an internal register. A frame-time-length setting unit 5 calculates the time length Ni of each frame from control data relating to the speech speed stored in the control-data storage unit 2 and speech-speed coefficients K (parameters used for determining the frame time length in accordance with the speech speed) stored in the parameter storage unit 4. A waveform-point-number storage unit 6 calculates the number of waveform points $n_w$ of one frame and stores the calculated number in an internal register. A synthesis-parameter interpolation unit 7 interpolates synthesis parameters stored in the parameter storage unit 4 using the frame time length Ni set by the frame-time-length setting unit 5 and the number of waveform points nw stored in the waveform-point-number storage unit 6. A pitch-scale interpolation unit 8 interpolates pitch scales stored in the parameter storage unit 4 using the frame time Ni set by the frame-time-length setting unit 5 and the number of waveform points nw stored in the waveform-point-number storage unit 6. A waveform generation unit 9 generates pitch waveforms using synthesis parameters interpolated by the synthesis-parameter interpolation unit 7 and the pitch scales interpolated by the pitch-scale interpolation unit 8, and outputs synthesized speech by connecting the pitch waveforms.

A description will now be provided of the generation of pitch waveforms performed by the waveform generation unit 9 with reference to FIGS. 2 through 6.

Figure 2A:
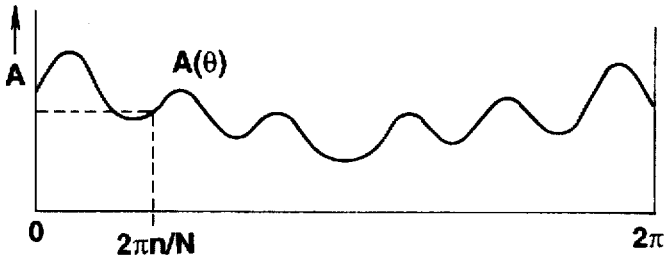
FIGS. 2A–2C are graphs illustrating synthesis parameters used in the embodiments.
Figure 2B:
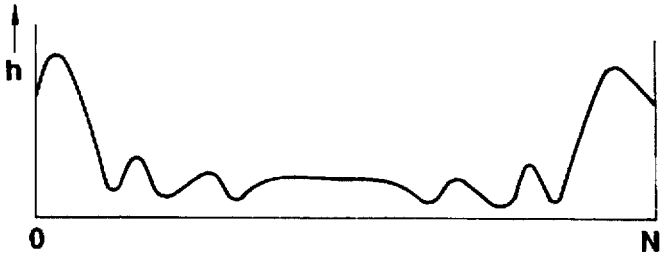
Figure 2C:
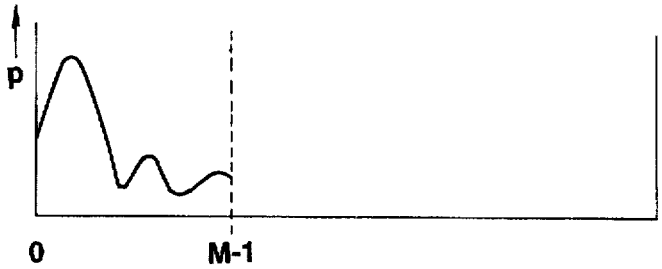

First, a description will be provided of synthesis parameters used for generating pitch waveforms. In FIGS. 2A–2C and in the other figures, N represents the degree of Fourier transform, and M represents the degree of synthesis parameters. N and M are arranged to satisfy the relationship of $N \geqq 2M$. Logarithmic power spectrum envelopes, a(n), of speech are expressed by:

$$a(n)=A(2\pi n/N)\ (0 \leqq n<N).$$

One such envelope is shown in FIG. 2A.

Impulse responses, h(n), obtained by inputting the logarithmic power spectrum envelopes into exponential functions to be returned to a linear form, and performing an inverse Fourier transform are expressed by:

$$h(n)=1/N\sum_{k=0}^{N-1}\exp(a(k))\cos(2\pi kn/N)\ (0 \leqq n \leqq N).$$

One such response is shown in FIG. 2B.

Synthesis parameters p(m) ($0 \leqq m<N$) shown in FIG. 2C can be obtained by doubling the values of the first degree and the subsequent degrees of the impulse responses relative to the value of the 0 degree. That is, with the condition of $r \neq 0$, where r is a real number which is not equal to zero, $p(0)=rh(0)$ $p(m)=2rh(m)\ (1 \leqq m<M).$ If the sampling frequency is expressed by $f_s$, the sampling period, $T_s$, is expressed by:

$T_s=1/f_s.$

If the pitch frequency of synthesized speech is represented by f, the pitch period is expressed by:

$T=1/f,$ and the number of pitch period points is expressed by:

$N_p(f)=f_sT=T/T_s=f_s/f.$

By quantizing the number of pitch period points with an integer, the following expression is obtained:

$N_p(f)=f_s/f,$ where [x] represents the maximum integer equal to or less than x. Thus, $N_p(f)$ equals the maximum integer equal to or less than $f_s/f$.

An angle θ for each pitch period point when the pitch period is made to correspond to an angle 2π is expressed by:

$$\theta=2\pi/N_p(f).$$

The values of spectrum envelopes at integer multiples of the pitch frequency are expressed by:

$$e(l)=\sum_{m=0}^{M-1}p(m)\cos(ml\theta)(1 \leqq l \leqq [N_p(f)/2])\ \text{(see FIG. 3)}.$$

If the pitch waveforms are expressed by:

$w(k)\ (0 \leqq k<N_p(f)),$ a power-normalized coefficient C(f) corresponding to the pitch frequency f is given by:

$$C(f)=\sqrt{f/f_0},$$

where $f_0$ is the pitch frequency at which $C(f)=1.0$.

By superposing sine waves of integer multiples of the fundamental frequency, the pitch waveforms w(k) ($0 \leqq k<N_p(f)$) are generated as:

$$w(k)=C(f)\sum_{l=1}^{[N_p(f)/2]}e(l)\sin(lk\theta) \tag{1}$$

$$w(k)=C(f)\sum_{l=1}^{[N_p(f)/2]}\sin(lk\theta)\sum_{m=0}^{M-1}p(m)\cos(ml\theta)$$

$$w(k)=C(f)\sum_{m=0}^{M-1}p(m)\sum_{l=1}^{[N_p(f)/2]}\sin(lk\theta)\cos(ml\theta).$$

Figure 4:
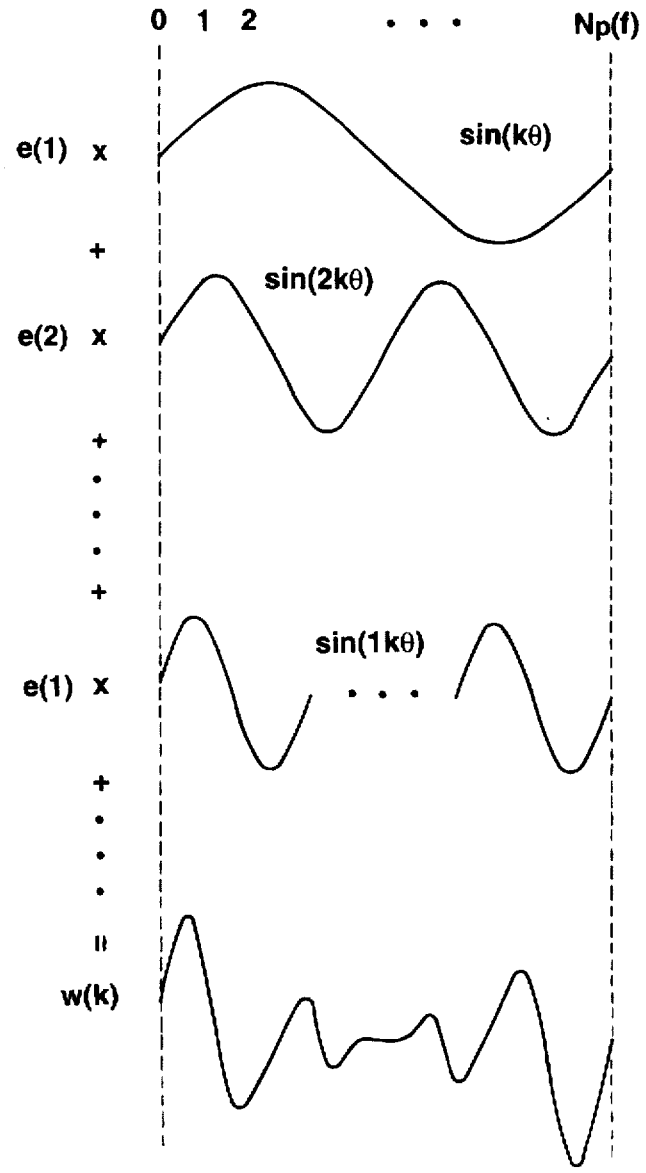
FIGS. 4 and 5 are graphs illustrating the superposition of sine waves.

In this embodiment all the summation over l are taken from $l=1$ to $l=[N_p(f)/2]$ (see FIG. 4).

Thus, FIG. 4 shows separate sine waves of integer multiples of the fundamental frequency, sin (kθ), sin (2kθ), . . . , sin (lkθ), which are multiplied by e(1), e(2), . . . , e(l), respectively, and added together to produce pitch waveform w(k) at the bottom of FIG. 4.

Alternatively, by superposing sine waves of integer multiples of the fundamental frequency while shifting them by half the phase of the pitch period, the pitch waveforms w(k) ($0 \leqq k<N_p(f)$) are generated as:

$$w(k)=C(f)\sum_{l=1}^{[N_p(f)/2]}e(l)\sin(l(k\theta+\pi)) \tag{2}$$

$$w(k)=C(f)\sum_{l=1}^{[N_p(f)/2]}\sin(l(k\theta+\pi))\sum_{m=0}^{M-1}p(m)\cos(ml\theta)$$

$$w(k)=C(f)\sum_{m=0}^{M-1}p(m)\sum_{l=1}^{[N_p(f)/2]}\sin(l(k\theta+\pi))\cos(ml\theta)$$

Figure 5:
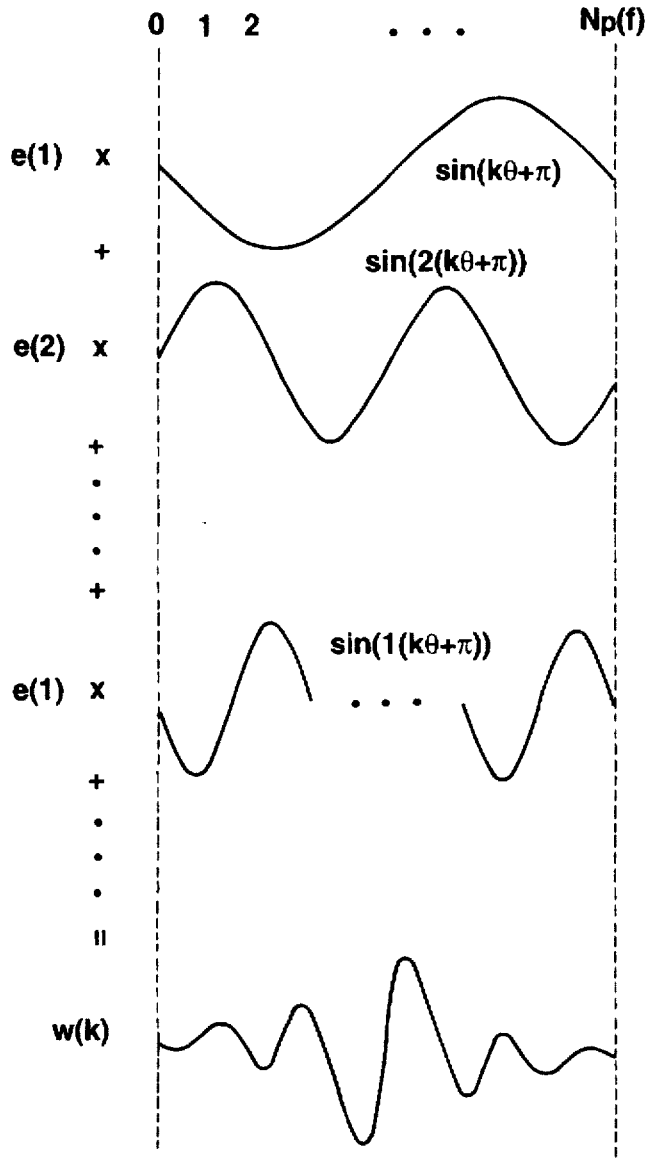

(see FIG. 5).

Specifically, FIG. 5 shows separate sine waves of integer multiples of the fundamental frequency shifted by half the phase of the pitch period, sin (kθ+π), sin (2(kθ+π), . . . , sin (l(kθ+π), which are multiplied by e(1), e(2), . . . , e(l), respectively, and added together to produce the pitch waveform w(k) at the bottom of FIG. 5.

A pitch scale is used as a scale for representing the pitch of speech. Instead of directly performing the calculation of expressions (1) and (2), the speed of calculation can be increased in the following manner. That is, if $\theta=2\pi/N_p(s)$, where $N_p(s)$ is the number of pitch period points corresponding to the pitch scale s, terms $$c_{km}(s)=\sum_{l=1}^{[N_p(f)/2]}\sin(lk\theta)\cos(ml\theta)$$

for expression (1), and $$c_{km}(s)=\sum_{l=1}^{[N_p(f)/2]}\sin(l(k\theta+\pi))\cos(ml\theta)$$

for expression (2) are calculated and the results of the calculation are stored in a table.

A waveform generation matrix is expressed as:

$WGM(s)=(c_{km}(s))\ (0 \leqq k<N_p(s),\ 0 \leqq m<M).$

In addition, the number of pitch period points $N_p(s)$ and the power-normalized coefficient C(s) corresponding to the pitch scale s are stored in the table.

The waveform generation unit 9 reads the number of pitch period points $N_p(s)$, the power-normalized coefficient C(s) and the waveform generation matrix $WGM(s)=(c_{km}(s))$ from the table while using the synthesis parameters p(m) ($0 \leqq m<M$) output from the synthesis-parameter interpolation unit 7 and the pitch scale s output from the pitch-scale interpolation unit 8 as inputs, and generates pitch waveforms according to:

$$w(k) = C(s) \sum_{m=0}^{M-1} c_{km}(s)p(m) \ (0 \leqq k < N_p(s))$$

Figure 6:
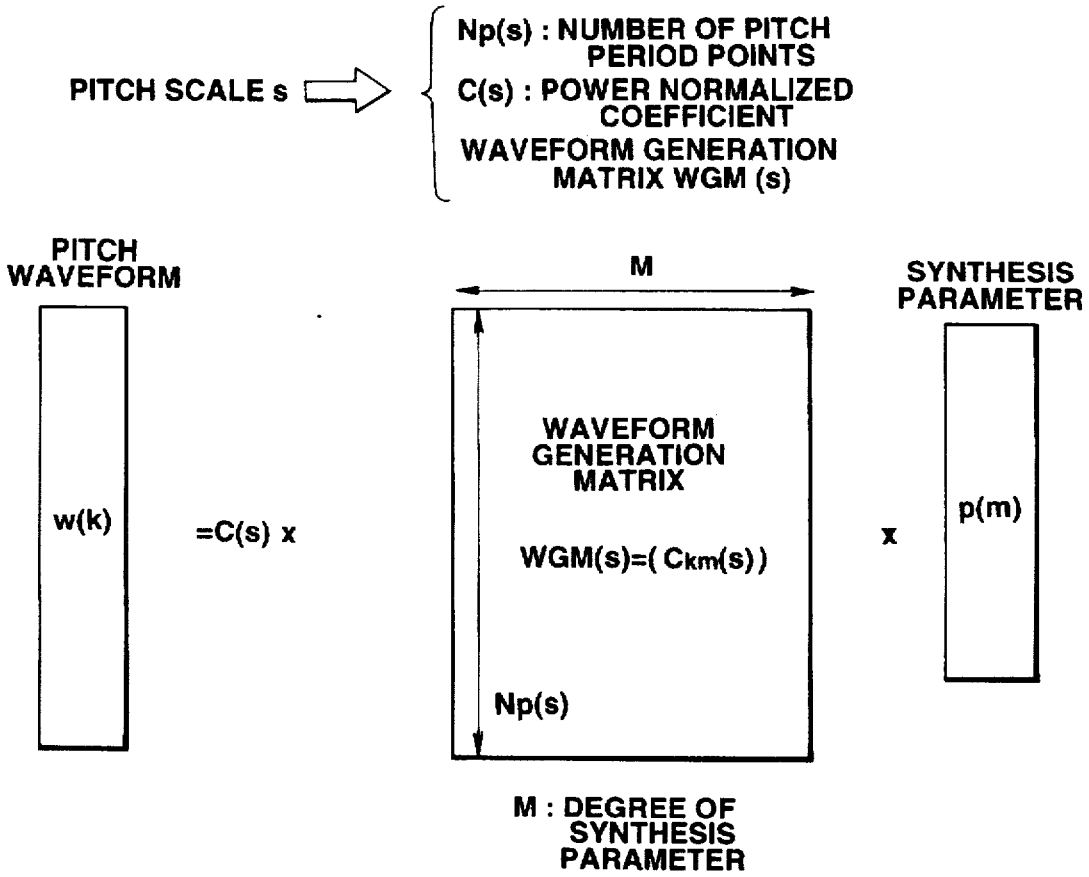
FIG. 6 is a schematic diagram illustrating the generation of pitch waveforms.

(see FIG. 6).

Figure 7:
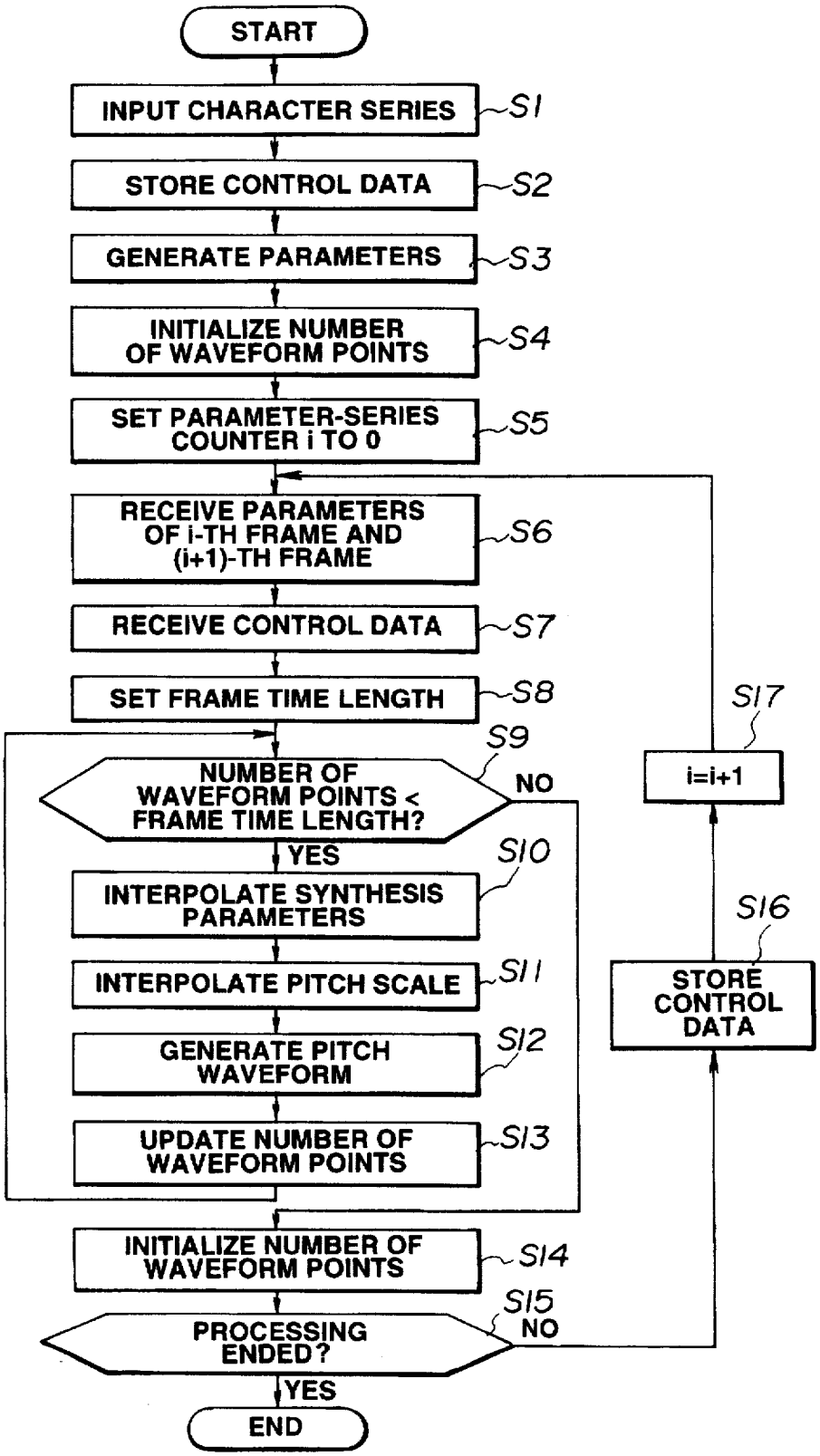
FIG. 7 is a flowchart illustrating the processing for generating a speech waveform.

The above-described operation from the input of a phonetic text to the generation of pitch waveforms will now be explained with reference to the flowchart shown in FIG. 7.

In step S1, a phonetic text is input into the character-series input unit 1.

In step S2, control data (relating to the speed and the pitch of the speech) input from outside of the apparatus and control data in the input phonetic text are stored in the control-data storage unit 2.

In step S3, the parameter generation unit 3 generates a parameter series from the phonetic text input from the character-series input unit 1.

FIG. 8 illustrates an example of the data structure for one frame of each parameter generated in step S3.

In step S4, the internal register of the waveform-point-number storage unit 6 is initialized to 0. If the number of waveform points is represented by $n_w$, $n_w=0$.

In step S5, a parameter-series counter i is initialized to 0.

In step S6, parameters of the i-th frame and the (i+1)-th frame are transmitted from the parameter generation unit 3 into the internal register of the parameter storage unit 4.

In step S7, the speech speed data is transmitted from the control-data storage unit 2 into the frame-time-length setting unit 5.

In step S8, the frame-time-length setting unit 5 sets the frame time length Ni using the speech-speed coefficients k of the parameters received in the parameter storage unit 4, and the speech speed data received from the control-data storage unit 2.

In step S9, by determining whether or not the number of waveform points $n_w$ is less than the frame time length Ni, the CPU 103 determines whether or not the processing of the i-th frame has been completed. If $n_w \geqq Ni$, the CPU 103 determines that the processing of the i-th frame has been completed, and the process proceeds to step S14. If $n_w<Ni$, the CPU 103 determines that the i-th frame is being processed, the process proceeds to step S10, and the processing is continued.

Figure 9:
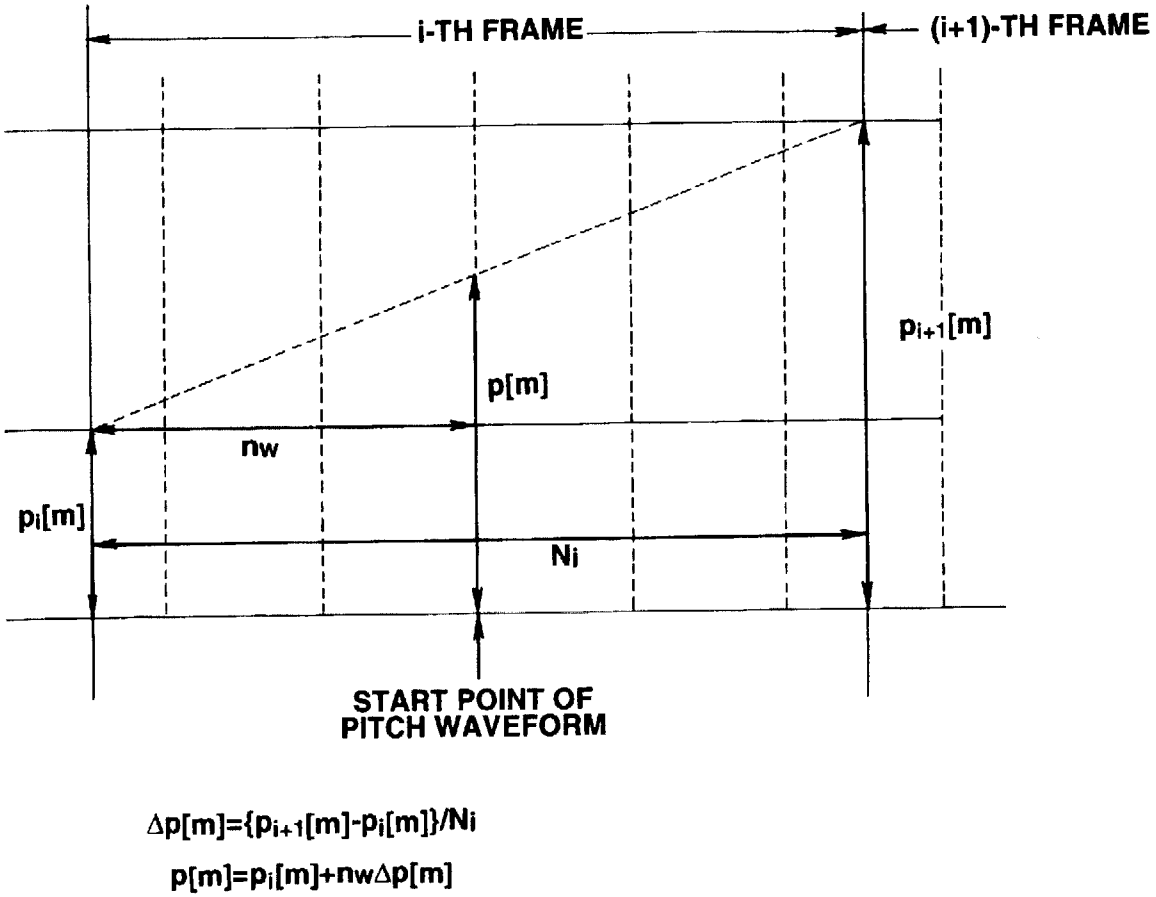
FIG. 9 is a schematic diagram illustrating the interpolation of synthesis parameters.

In step S10, the synthesis-parameter interpolation unit 7 interpolates synthesis parameters using synthesis parameters received from the parameter storage unit 4, the frame time length set by the frame-time-length setting unit 5, and the number of waveform points stored in the waveform-point-number storage unit 6. FIG. 9 illustrates the interpolation of synthesis parameters. If synthesis parameters of the i-th frame and the (i+1)-th frame are represented by $p_i[m]$ $(0 \leqq m<M)$ and $p_{i+1}[m]$ $(0 \leqq m<M)$, respectively, and the time length of the i-th frame equals $N_i$ points, the difference $\Delta p[m]$ $(0 \leqq m<M)$ between synthesis parameters per point is expressed by:

$$\Delta p[m]=(p_{i+1}[m]-p_i[m])/N_i.$$

The synthesis parameters p[m] $(0 \leqq m<M)$ are updated every time a pitch waveform is generated.

The processing of $$p[m]=p_i[m]+n_w\Delta p[m] \tag{3}$$

is performed at the start point of the pitch waveform.

Figure 10:
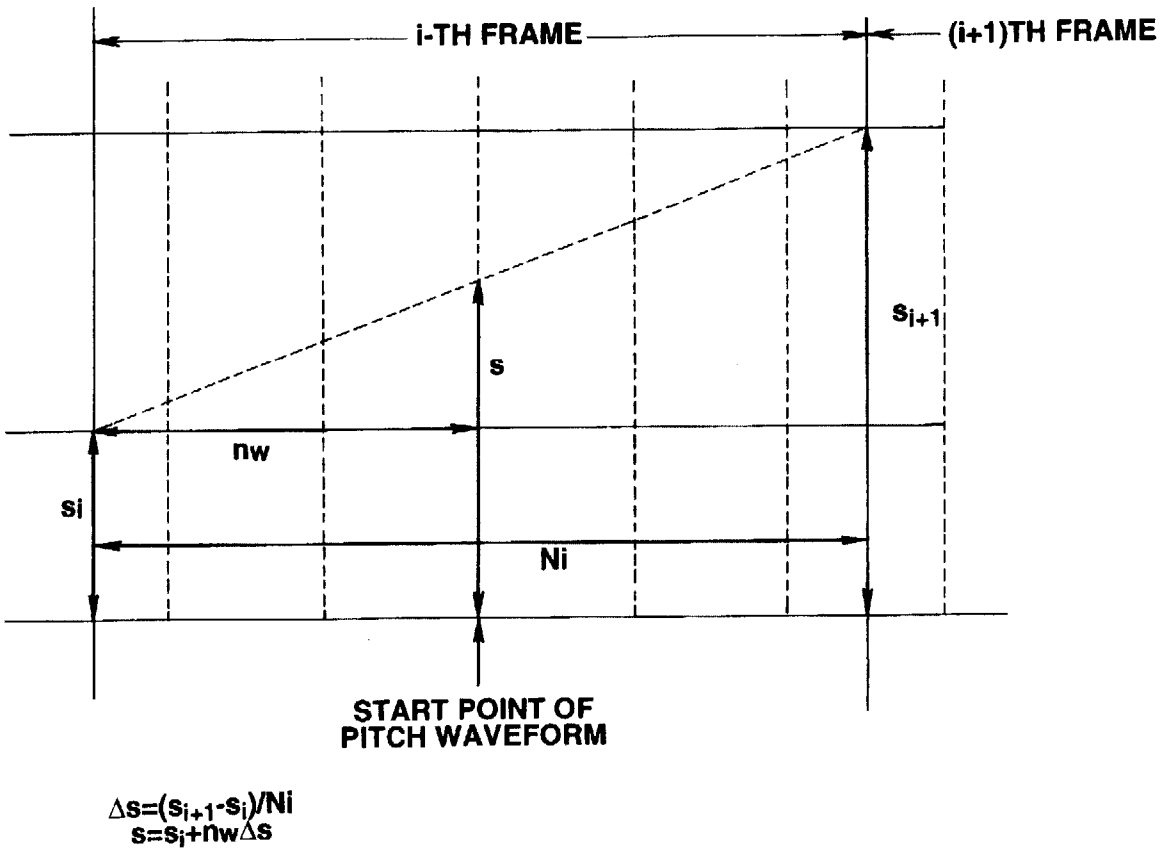
FIG. 10 is a schematic diagram illustrating the interpolation of pitch scales.

In step S11, the pitch-scale interpolation unit 8 interpolates pitch scales using the pitch scales received from the parameter storage unit 4, the frame time length set by the frame-time-length setting unit 5, and the number of waveform points stored in the waveform-point-number storage unit 6. FIG. 10 illustrates the interpolation of pitch scales. If the pitch scales of the i-th frame and the (i+1)-th frame are represented by $s_i$ and $s_{i+1}$, respectively, and the frame time length of the i-th frame equals $N_i$ points, the difference $\Delta S$ between pitch scales per point is expressed by:

$$\Delta S=(s_{i+1}-s_i)/N_i.$$

The pitch scale s is updated every time a pitch waveform is generated. The processing of $$s=s_i+n_w\Delta S \tag{4}$$

is performed at the start point of the pitch waveform.

In step S12, the waveform generation unit 9 generates pitch waveforms using the synthesis parameters p[m] $(0 \leqq m<M)$ obtained from expression (3) and the pitch scale s obtained from expression (4). The number of pitch period points $N_p(s)$, the power-normalized coefficients C(s), and the waveform generation matrix $WGM(s)=(c_{km}(s))(0 \leqq k<N_p(s), 0 \leqq m<M)$ corresponding to the pitch scale s are read from the table, and pitch waveforms are generated using the following expression:

$$w(k) = C(s) \sum_{m=0}^{M-1} c_{km}(s)p(m) \ (0 \leqq k < N_p(s)).$$

Figure 11:
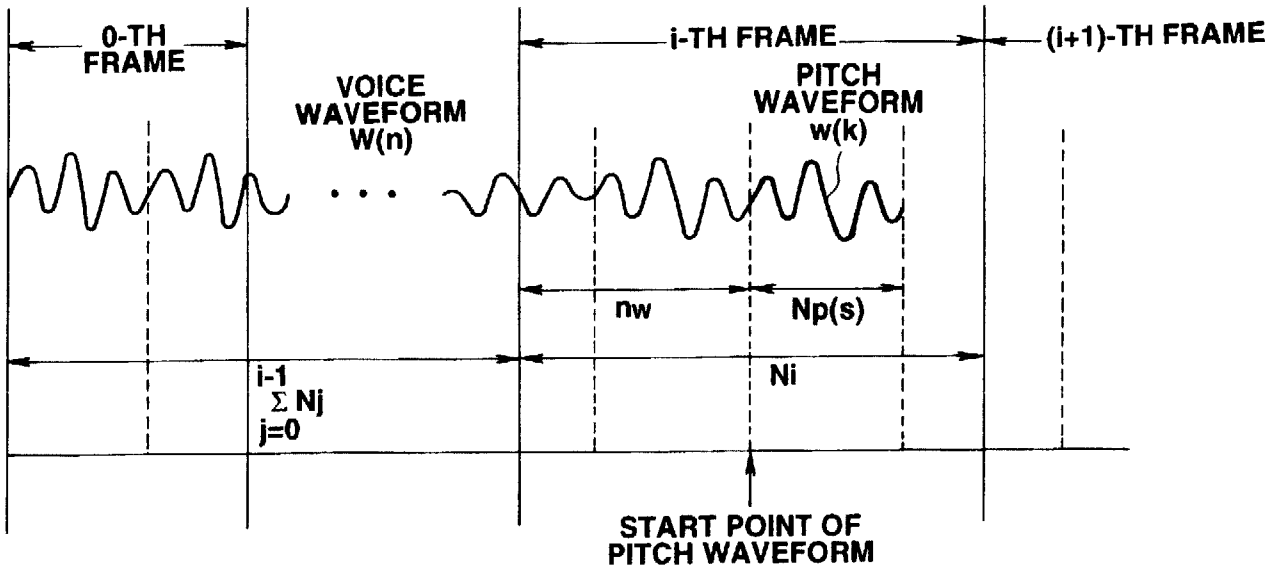
FIG. 11 is a schematic diagram illustrating the connection of waveforms.

FIG. 11 is a diagram illustrating the connection of the generated pitch waveforms. If a speech waveform output from the waveform generation unit 9 as synthesized speech is expressed by:

W(n) $(0 \leqq n)$, the connection of the pitch waveforms is performed according to:

$$W(n_w + k) = w(k) \ (i = 0, 0 \leqq k < N_p(s))$$

$$W\left(\sum_{j=0}^{i-1} N_j + n_w + k\right) = w(k) \ (i > 0, 0 \leqq k < N_p(s)),$$

where $N_j$ is the frame time length of the j-th frame.

In step S13, the waveform-point-number storage unit 6 updates the number of waveform points $n_w$ as $$n_w=n_w+N_p(s).$$

The process then returns to step S9, and the processing is continued.

If $n_w \geqq N_i$ in step S9, the process proceeds to step S14.

In step S14, the number of waveform points $n_w$ is initialized as:

$$n_w=n_w-N_i.$$

In step S15, the CPU 103 determines whether or not all frames have been processed. If the result of the determination is negative, the process proceeds to step S16.

In step S16, control data (relating to the speed and the pitch of the speech) input from the outside is stored in the control-data storage unit 2. In step S17, the parameter-series counter i is updated as:

$$i=i+1.$$

Then, the process returns to step S6, and the processing is continued.

When the CPU 103 determines in step S15 that all frames have been processed, the processing is terminated.

Second Embodiment

As in the case of the first embodiment, FIGS. 25 and 1 are block diagrams illustrating the configuration and the functional configuration of a speech synthesis apparatus according to a second embodiment of the present invention, respectively.

In the present embodiment, a description will be provided of a case in which in order to express a decimal portion of the number of pitch period points, pitch waveforms whose phases are shifted are generated and connected.

A description will now be provided of the generation of pitch waveforms by the waveform generation unit 9 with reference to FIGS. 12A–12D.

Synthesis parameters used for generating pitch waveforms are expressed by p(m) ($0<m\leqq M$). If the sampling frequency is expressed by $f_s$, the sampling period is expressed by:

$$T_s=1/f_s.$$

If the pitch frequency of synthesized speech is represented by f, the pitch period is expressed by:

$$T=1/f,$$

and the number of pitch period points is expressed by:

$$N_p(f)=f_sT=T/T_s=f_s/f.$$

The decimal portion of the number of pitch period points is expressed by connecting pitch waveforms whose phases are shifted with respect to each other. The number of pitch waveforms corresponding to the frequency f is expressed by a phase number $n_p(f)$. FIGS. 12A–12D illustrate pitch waveforms when $n_p(f)=3$. In addition, the number of expanded pitch period points is expressed by:

$$N(f)=[n_p(f)N_p(f)]=[n_p(f)f_s/f],$$

and the number of pitch period points is quantized as:

$$N_p(f)=N(f)/n_p(f).$$

An angle $\theta_1$ for each point when the number of pitch period points is made to correspond to an angle $2\pi$ is expressed by:

$$\theta_1=2\pi/N_p(f).$$

The values of spectrum envelopes at integer multiples of the pitch frequency are expressed by:

$$e(l)=\sum_{m=0}^{M-1} p(m)\cos(ml\theta_1)\ (1\leqq l\leqq [N_p(f)/2]).$$

An angle $\theta_2$ for each point when the number of expanded pitch period points is made to correspond to $2\pi$ is expressed by:

$$\theta_2=2\pi/N(f).$$

If the expanded pitch waveforms are expressed by:

$$w(k)\ (0\leqq k<N(f)),$$

a power-normalized coefficient corresponding to the pitch frequency f is given by:

$$C(f)=\sqrt{f/f_0}\ ,$$

where $f_0$ is the pitch frequency at which $C(f)=1.0$.

By superposing sine waves of integer multiples of the fundamental frequency, the expanded pitch waveforms w(k) ($0<k\leqq N(f)$) are generated as:

$$w(k)=C(f)\sum_{l=1}^{[N_p(f)/2]} e(l)\sin(lkn_p(f)\theta_2) \tag{5}$$

$$w(k)=C(f)\sum_{l=1}^{[N_p(f)/2]} \sin(lkn_p(f)\theta_2)\sum_{m=0}^{M-1} p(m)\cos(ml\theta_1)$$

$$w(k)=C(f)\sum_{m=0}^{M-1} p(m)\sum_{l=1}^{[N_p(f)/2]} \sin(lkn_p(f)\theta_2)\cos(ml\theta_1).$$

In this embodiment all equations involving the summations over l are taken from l=1 to $l=[N_p(f)/2]$.

Alternatively, by superposing sine waves of interger multiples of the fundamental frequency while shifting them by half the phase of the pitch period, the expanded pitch waveforms w(k) ($0\leqq k<N(f)$) are generated as:

$$w(k)=C(f)\sum_{l=1}^{[N_p(f)/2]} e(l)\sin(l(kn_p(f)\theta_2+\pi)) \tag{6}$$

$$w(k)=C(f)\sum_{l=1}^{[N_p(f)/2]} \sin(l(kn_p(f)\theta_2+\pi))\sum_{m=0}^{M-1} p(m)\cos(ml\theta_1)$$

$$w(k)=C(f)\sum_{m=0}^{M-1} p(m)\sum_{l=1}^{[N_p(f)/2]} \sin(l(kn_p(f)\theta_2+\pi))\cos(ml\theta_1).$$

A phase index is represented by:

$$i_p(0\leqq i_p<n_p(f)).$$

A phase angle corresponding to the pitch frequency f and the phase index $i_p$ is defined as:

$$\phi(f,i_p)=(2\pi/n_p(f))i_p.$$

The following definition is made:

$$r(f,i_p)=i_pN(f)\bmod n_p(f),$$

where a mod b represents a remainder obtained when a is divided by b.

The number of pitch waveform points of the pitch waveform corresponding to the phase index $i_p$ is calculated by the following expression:

$$P(f,i_p)=[(i_p+1)N(f)/n_p(f)]-[1-r(f,i_p+1)/n_p(f)]-[i_pN(f)/n_p(f)]+[1-r(f,i_p)/n_p(f)].$$

The pitch waveform corresponding to the phase index $i_p$ is expressed by:

$$w_p(k)=\begin{cases} w(k) & \text{when } (i_p=0,\ 0<k<P(f,i_p)) \\ w\left(\sum_{j=0}^{i_p-1} P(f,j)+k\right) & \text{when } (0<i_p<n_p(f),\ 0<k<P(f,i_p)). \end{cases}$$

Thereafter, the phase index is updated as:

$$i_p=(i_p+1)\bmod n_p(f),$$

and the phase angle is calculated using the updated phase index as:

$\phi_p = \phi(f, i_p)$.

When the pitch frequency is changed to f' when generating the next pitch waveform, in order to obtain the phase angle nearest to the phase angle $\phi_p$, i' satisfying the following expression is obtained:

$$|\phi(f', i') - \phi_p| = \min_{0 \leqq i < n_p(f')} |\phi(f', i) - \phi_p|,$$

and $i_p$ is determined so that $i_p = i'$.

A pitch scale is used as a scale for representing the pitch of speech. Instead of directly performing the calculation of expressions (5) and (6), the speed of calculation can be increased in the following manner. That is, if the phase number, the phase index, the number of expanded pitch period points, the number of pitch period points, and the number of pitch waveform points corresponding to a pitch scale $s \in S$ (S being a set of pitch scales) are represented by $n_p(s)$, $i_p (0 \leqq i_p < n_p(s))$, $N(s)$, $N_p(s)$, and $P(s, i_p)$, respectively, and $$\theta_1 = 2\pi / N_p(s)$$
$$\theta_2 = 2\pi / N(s),$$

$$c_{km}(s, i_p) = \begin{cases} \sum_{l=1}^{[N_p(f)/2]} \sin((lkn_p(s)\theta_2)\cos(ml\theta_1) & \text{when } (i_p = 0) \\ \sum_{l=1}^{[N_p(f)/2]} \sin\left(l\left(\sum_{j=0}^{i_p-1} P(s,j) + k\right) n_p(s)\theta_2\right)\cos(ml\theta_1) & \text{when } (0 < i_p < n_p(s)) \end{cases}$$

for expression (5), and $$c_{km}(s, i_p) = \begin{cases} \sum_{l=1}^{[N_p(f)/2]} \sin(l(kn_p(s)\theta_2 + \pi))\cos(ml\theta_1) & \text{when } (i_p = 0) \\ \sum_{l=1}^{[N_p(f)/2]} \sin\left(l\left(\left(\sum_{j=0}^{i_p-1} P(s,j) + k\right) n_p(s)\theta_2 + \pi\right)\cos(ml\theta_1)\right) & \text{when } (0 < i_p < n_p(s)) \end{cases}$$

are calculated, and the results of the calculation are stored in a table. A waveform generation matrix is expressed as:

$$WGM(s, i_p) = (c_{km}(s, i_p)) \ (0 \leqq k < P(s, i_p),\ 0 \leqq m < M).$$

The phase angle $\phi(s, i_p) = (2\pi / n_p(s)) i_p$ corresponding to the pitch scale s and the phase index $i_p$ is stored in the table. In addition, the correspondence relationship for providing $i_0$ which satisfies $$|\phi(s, i_0) - \phi_p| = \min_{0 \leqq i < N_p(s)} |\phi(s, i) - \phi_p|$$

for the pitch scale s and the phase angle $\phi_p (\in \{\phi(s, i_p) | s \in S,\ 0 \leqq i < n_p(s)\})$ is expressed as:

$$i_0 = I(s, \phi_p),$$

and is stored in the table. The number of phases $n_p(s)$, the number of pitch waveform points $P(s, i_p)$, and the power-normalized coefficients C(s) corresponding to the pitch scale s and the phase index $i_p$ are also stored in the table.

The waveform generation unit 9 determines a phase index $i_p$ stored in an internal register by:

$$i_p = I(s, \phi_p),$$

where $\phi_p$ is the phase angle, and reads the number of pitch waveform points $P(s, i_p)$, the power-normalized coefficients C(s) and the waveform generation matrix $WGM(s, i_p) = (c_{km}(s, i_p))$ from the table while using the synthesis parameters p(m) $(0 \leqq m < M)$ output from the synthesis-parameter interpolation unit 7 and the pitch scale s output from the pitch-scale interpolation unit 8 as inputs, and generates pitch waveforms according to:

$$w_p(k) = C(s) \sum_{m=0}^{M-1} c_{km}(s, i_p) p(m) \ (0 \leqq k < N_p(s, i_p)).$$

After generating the pitch waveforms, the phase index is updated as:

$$i_p = (i_p + 1) \bmod n_p(s),$$

and updates the phase angle using the updated phase index as:

$$\phi_p = \phi(s, i_p).$$

Figure 12A:
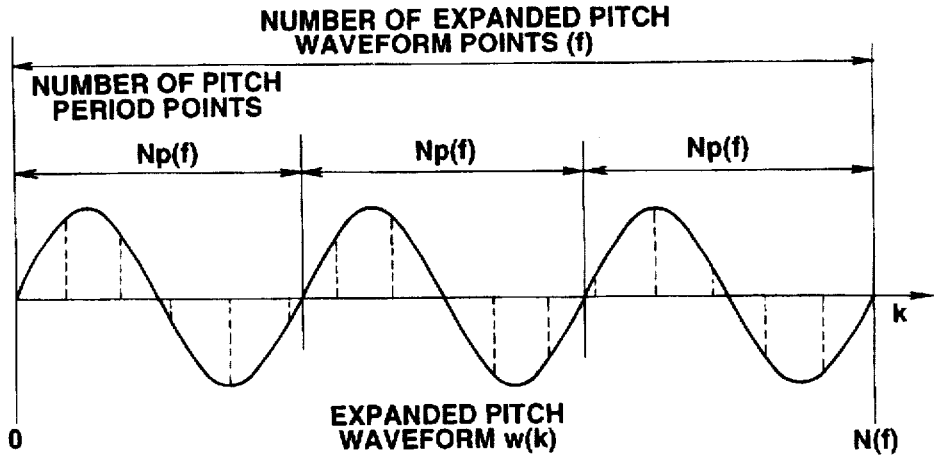
FIGS. 12A–12D are graphs illustrating pitch waveforms.
Figure 12B:
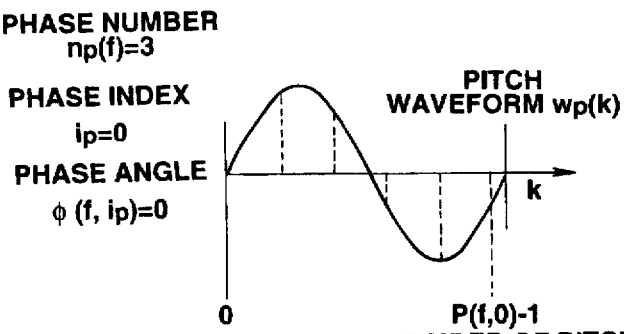
Figure 12C:
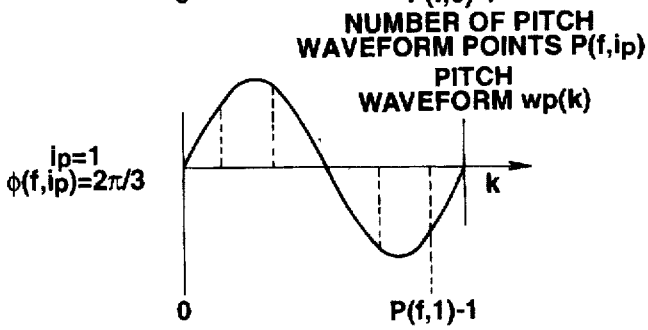
Figure 12D:
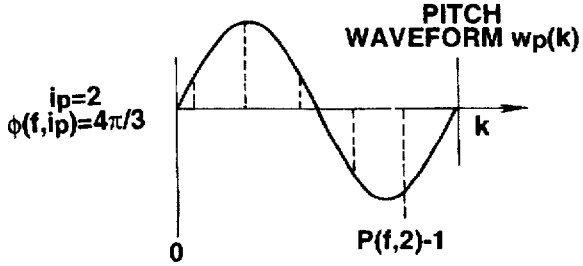

FIG. 12A shows the expanded pitch waveform w(k), the number of pitch period points $N_p(f)$, and the number of expanded pitch waveform points (f). FIG. 12B shows the pitch waveform $w_p(k)$, a phase number $n_p(f)$ of 3, a phase index $i_p$ of 0, a phase angle $\phi(f, i_p)$ of 0, and the number of pitch waveform points $P(f, i_p)$ and $P(f, 0) - 1$. FIG. 12C shows a pitch waveform $w_p(k)$, a phase index $i_p$ of 1, a phase angle $\phi(f, i_p)$ of $2\pi/3$, and $P(f, 1) - 1$. FIG. 12D shows a pitch waveform $w_p(k)$, a phase index $i_p$ of 2, a phase angle $\phi(f, i_p)$ of $4\pi/3$, and $P(f, 2) - 1$.

Figure 13:
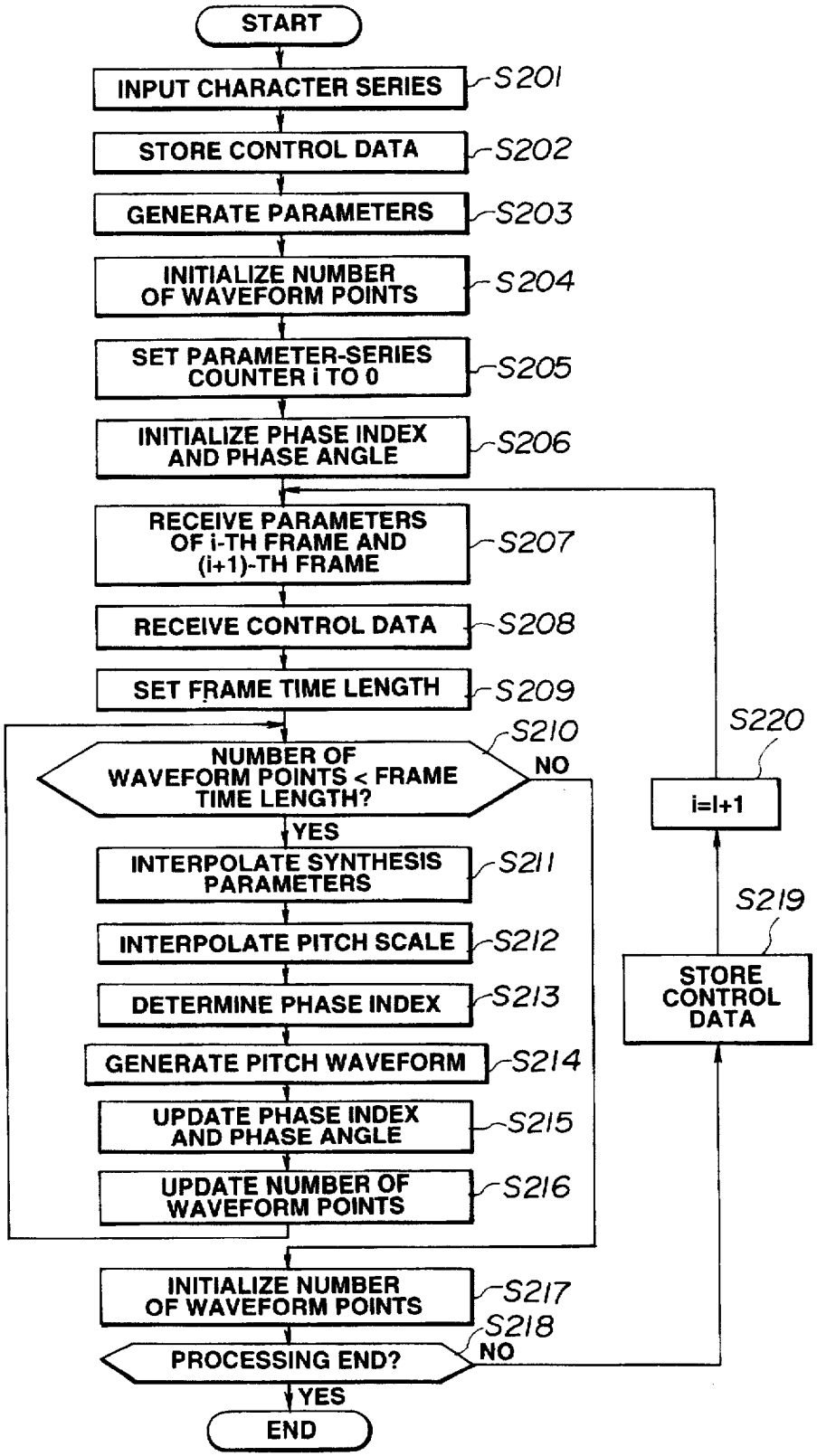
FIG. 13 is a flowchart illustrating the processing for generating a speech waveform.

The above-described operation will now be explained with reference to the flowchart shown in FIG. 13.

In step S201, a phonetic text is input into the character-series input unit 1.

In step S202, control data (relating to the speed and the pitch of the speech) input from outside of the apparatus and control data in the input phonetic text are stored in the control-data storage unit 2.

In step S203, the parameter generation unit 3 generates a parameter series from the phonetic text input from the character-series input unit 1.

The data structure for one frame of each parameter generated in step S203 is the same as in the first embodiment, and is shown in FIG. 8.

In step S204, the internal register of the waveform-point-number storage unit 6 is initialized to 0. If the number of waveform points is represented by $n_w$, $n_w = 0$.

In step S205, a parameter-series counter i is initialized to 0.

In step S206, the phase index $i_p$ and the phase angle $\phi_p$ are initialized to 0.

In step S207, parameters of the i-th frame and the (i+1)-th frame are transmitted from the parameter generation unit 3 into the parameter storage unit 4.

In step S208, the speech speed data is transmitted from the control-data storage unit 2 into the frame-time-length setting unit 5.

In step S209, the frame-time-length setting unit 5 sets the frame time length Ni using the speech-speed coefficients of the parameters received in the parameter storage unit 4, and the speech speed data received from the control-data storage unit 2.

In step S210, the CPU 103 determines whether or not the number of waveform points $N_w$ is less than the frame time length Ni. If $N_w$>Ni, the process proceeds to step S217. If $N_w$<Ni, the step proceeds to step S211, and the processing is continued.

In step S211, the synthesis-parameter interpolation unit 7 interpolates synthesis parameters using synthesis parameters received from the parameter storage unit 4, the frame time length set by the frame-time-length setting unit 5, and the number of waveform points stored in the waveform-point-number storage unit 6. The interpolation of parameters is the same as in step S10 of the first embodiment.

In step S212, the pitch-scale interpolation unit 8 interpolates pitch scales using the pitch scales received from the parameter storage unit 4, the frame time length set by the frame-time-length setting unit 5, and the number of waveform points stored in the waveform-point-number storage unit 6. The interpolation of pitch scales is the same as in step S11 of the first embodiment.

In step S213, the phase index is determined according to:

$$i_p=I(s,\phi_p)$$

using the pitch scale s obtained from expression (4) and the phase angle $\phi_p$.

In step S214, the waveform generation unit 9 generates a pitch waveform using the synthesis parameters p[m] ($0 \leqq m < M$) obtained from expression (3) and the pitch scale s obtained from expression (4). The number of pitch waveform points $P(s,i_p)$, the power-normalized coefficient C(s) and the waveform generation matrix $WGM(s,i_p)=(c_{km}(s,i_p))$ ($0 \leqq k < P(s,i_p)$, $0 \leqq m < M$) corresponding to the pitch scale s are read from the table, and pitch waveforms are generated using the following expression:

$$w_p(k) = C(s) \sum_{m=0}^{M-1} c_{km}(s,i_p)p(m) \ (0 \leqq k < P(s,i_p)).$$

If a speech waveform output from the waveform generation unit 9 as synthesized speech is expressed by:

W(n) ($0 \leqq n$), the connection of the pitch waveforms is performed according to $$W(n_w + k) = w_p(k) \ (i = 0, 0 \leqq k < P(s,i_p))$$

$$W\left(\sum_{j=0}^{i-1} N_j + n_w + k\right) = w_p(k) \ (i > 0, 0 \leqq k < P(s,i_p)),$$

where $N_j$ is the frame time length of the j-th frame.

In step S215, the phase index is updated as:

$$i_p=(i_p+1) \bmod n_p(s),$$

and the phase angle is updated using the updated phase index $i_p$ as:

$$\phi_p=\phi(s,i_p).$$

In step S216, the waveform-point-number storage unit 6 updates the number of waveform points $n_w$ as $$n_w=n_w+P(s,i_p).$$

The process then returns to step S210, and the processing is continued.

If $n_w \geqq N_i$ in step S210, the process proceeds to step S217.

In step S217, the number of waveform points $n_w$ is initialized as:

$$n_w=n_w-N_i.$$

In step S218, the CPU 103 determines whether or not all frames have been processed. If the result of the determination is negative, the process proceeds to step S219.

In step S219, control data (relating to the speed and the pitch of the speech) input from the outside is stored in the control-data storage unit 2. In step S220, the parameter-series counter i is updated as:

$$i=i+1.$$

Then, the process returns to step S207, and the processing is continued.

When it has been determined in step S218 that all frames have been processed, the processing is terminated.

Third Embodiment

In a third embodiment of the present invention, a description will be provided of generation of unvoiced waveforms in addition to the method for generating pitch waveforms in the first embodiment.

Figure 14:
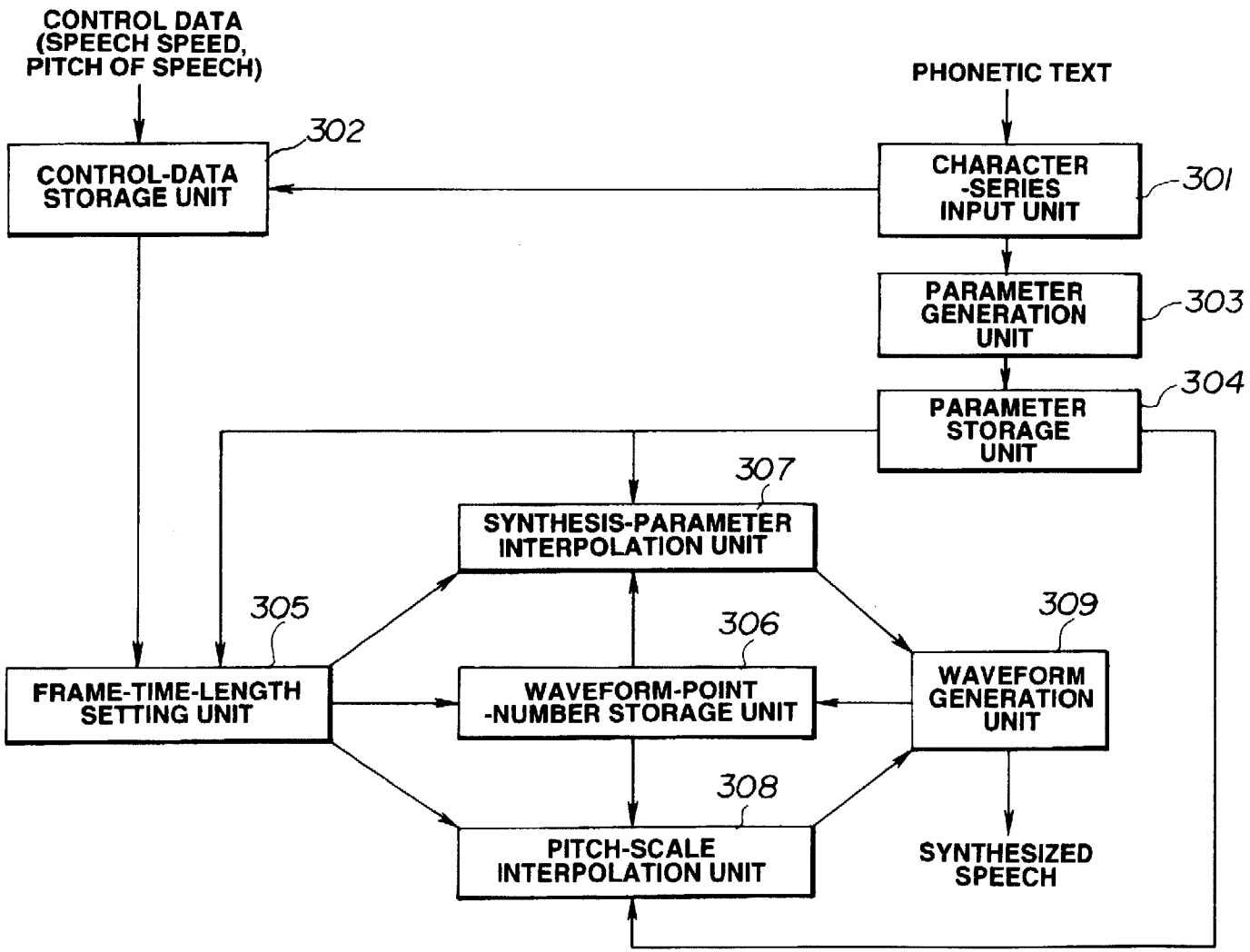
FIG. 14 is a block diagram illustrating the functional configuration of a speech synthesis apparatus according to a third embodiment of the present invention.

FIG. 14 is a block diagram illustrating the functional configuration of a speech synthesis apparatus according to the third embodiment. Respective functions are executed under the control of the CPU 103 shown in FIG. 25. Reference numeral 301 represents a character-series input unit for inputting a character series of speech to be synthesized. For example, if a word to be synthesized is "speech", a character series of a phonetic text, such as "spi:tʃ", is input into unit 301. A character series input from the character-series input unit 301 includes, in some cases, a character series indicating, for example, a control sequence for setting the speed and the pitch of speech, and the like in addition to a phonetic text. The character-series input unit 301 determines whether the input character series comprises a phonetic text or a control sequence. A control-data storage unit 302 stores in an internal register a character series, which has been determined to be a control sequence and which has been transmitted by the character-series input unit 301. The unit 302 also stores control data, such as the speed and the pitch of a speech input from a user interface, in an internal register. When the character-series input unit 301 determines that an input character series is a phonetic text, it transmits the character series to a parameter generation unit 303 which reads and generates a parameter series stored in the ROM 105 therefrom in accordance with the input character series. A parameter storage unit 304 extracts parameters of a frame to be processed from the parameter series generated by the parameter generation unit 303, and stores the extracted parameters in an internal register. A frame-time-length setting unit 305 calculates the time length Ni of each frame from control data relating to the speech speed stored in the control-data storage unit 302 and speech-speed coefficients K (parameters used for determining the frame time length in accordance with the speech speed) stored in the parameter storage unit 304. A waveform-point-number storage unit 306 calculates the number of waveform points nw of one frame and stores the calculated number in an internal register. A synthesis-parameter interpolation unit 307 interpolates synthesis parameters stored in the parameter storage unit 304 using the frame time length Ni set by the frame-time-length setting unit 305 and the number of waveform points nw stored in the waveform-point-number storage unit 306. A pitch-scale interpolation unit 308 interpolates pitch scales stored in the parameter storage unit 304 using the frame time Ni set by the frame-time-length setting unit 305 and the number of waveform points $n_w$ stored in the waveform-point-number storage unit 306. A waveform generation unit 309 generates pitch waveforms using synthesis parameters interpolated by the synthesis-parameter interpolation unit 307 and the pitch scales interpolated by the pitch-scale interpolation unit 308, and outputs synthesized speech by connecting the pitch waveforms. The waveform generation unit 309 also generates unvoiced waveforms from the synthesis parameters output from the synthesis-parameter interpolation unit 307, and outputs a synthesized speech by connecting the unvoiced waveforms.

The generation of pitch waveforms performed by the waveform generation unit 309 is the same as that performed by the waveform generation unit 9 in the first embodiment.

In the present embodiment, a description will be provided of generation of voiceless waveforms performed by the waveform generation unit 309 in addition to the generation of pitch waveforms.

Synthesis parameters used in the generation of voiceless waveforms are represented by:

$p(m)$ $(0 \leqq m < N)$.

If the sampling frequency is expressed by $f_s$, the sampling period is expressed by:

$$T_s = 1/f_s.$$

The pitch frequency of sine waves used in the generation of unvoiced waveforms is represented by f, which is set to a frequency lower than the audible frequency band. [x] represents the maximum integer equal to or less than x.

The number of pitch period points corresponding to the pitch frequency f is expressed by:

$$N_p(f) = [f_s/f].$$

The number of unvoiced waveform points is represented by:

$$N_{uv} = N_p(f).$$

An angle θ for each point when the number of unvoiced waveform points is made to correspond to an angle 2π is expressed by:

$$\theta = 2\pi/N_{uv}.$$

The values of spectrum envelopes at integer multiples of the pitch frequency f are expressed by:

$$e(l) = \sum_{m=0}^{M-1} p(m)\cos(ml\theta) \; (1 \leqq l \leqq [N_{uv}(f)/2]).$$

If the unvoiced waveforms are expressed by:

$W_{uv}(k)$ $(0 < k < N_{uv})$, a power-normalized coefficient C(f) corresponding to the pitch frequency f is given by:

$$C(f) = \sqrt{f/f_0},$$

where $f_0$ is the pitch frequency at which C(f)=1.0.

The power-normalized coefficient used in the generation of unvoiced waveforms is expressed by:

$$C_{uv} = C(f).$$

By superposing sine waves of integer multiples of the fundamental pitch frequency f while randomly shifting phases, unvoiced waveforms are generated. Phase shifts are represented by $\alpha_1 (1 \leqq 1 \leqq [N_{uv}/2]$. The values of $\alpha_1$ are set to random values which satisfy the following condition:

$$-\pi < \alpha_1 < \alpha\pi.$$

The unvoiced waveforms $w_{uv}(k)$ $(0 \leqq k < N_{uv})$ are generated as:

$$w_{uv}(k) = C_{uv} \sum_{l=1}^{[N_{uv}/2]} e(l)\sin(lk\theta + \alpha_1) \tag{7}$$

$$w_{uv}(k) = C_{uv} \sum_{l=1}^{[N_{uv}/2]} \sin(lk\theta + \alpha_1) \sum_{m=0}^{M-1} p(m)\cos(ml\theta)$$

$$w_{uv}(k) = C_{uv} \sum_{m=0}^{M-1} p(m) \sum_{l=1}^{[N_{uv}/2]} \sin(lk\theta + \alpha_1)\cos(ml\theta).$$

In this embodiment all summations over l are from l=1 to $l=[N_{uv}/2]$.

Instead of directly performing the calculation of expression (7), the speed of the calculation can be increased in the following manner. That is, terms $$c(i_{uv}, m) = \sum_{l=1}^{[N_{uv}/2]} \sin(li_{uv}\theta + \alpha_1)\cos(ml\theta) \; (0 \leqq m < M),$$

are calculated and the results of the calculation are stored in a table, where $i_{uv}$ $(0 \leqq i_{uv} < N_{uv})$ is the unvoiced waveform index.

An unvoiced-waveform generation matrix is expressed as:

$$UVWGM(i_{uv}) = (c(i_{uv}, m)) \; (0 \leqq i_{uv} < N_{uv}, \; 0 \leqq m < M).$$

In addition, the number of pitch period points $N_{uv}$ and power-normalized coefficient $C_{uv}$ are stored in the table.

The waveform generation unit 309 reads the power-normalized coefficient $C_{uv}$ and the unvoiced-waveform generation matrix $UVWGM(i_{uv}) = (c(i_{uv}, m))$ from the table while using the unvoiced waveform index $i_{uv}$ stored in the internal register and the synthesis parameters p(m) $(0 \leqq m < M)$ output from the synthesis-parameter interpolation unit 307 as inputs, and generates unvoiced waveforms of one point according to:

$$w_{uv}(i_{uv}) = C_{uv} \sum_{m=0}^{M-1} c(i_{uv}, m)p(m).$$

After the unvoiced waveforms have been generated, the number of pitch period points $N_{uv}$ are read from the table, the unvoiced waveform index $i_{uv}$ is updated as:

$$i_{uv} = (i_{uv} + 1) \bmod N_{uv},$$

and the number of waveform points stored in the waveform-point-number storage unit 306 is updated as:

$$n_w = n_w + 1.$$

Figure 15:
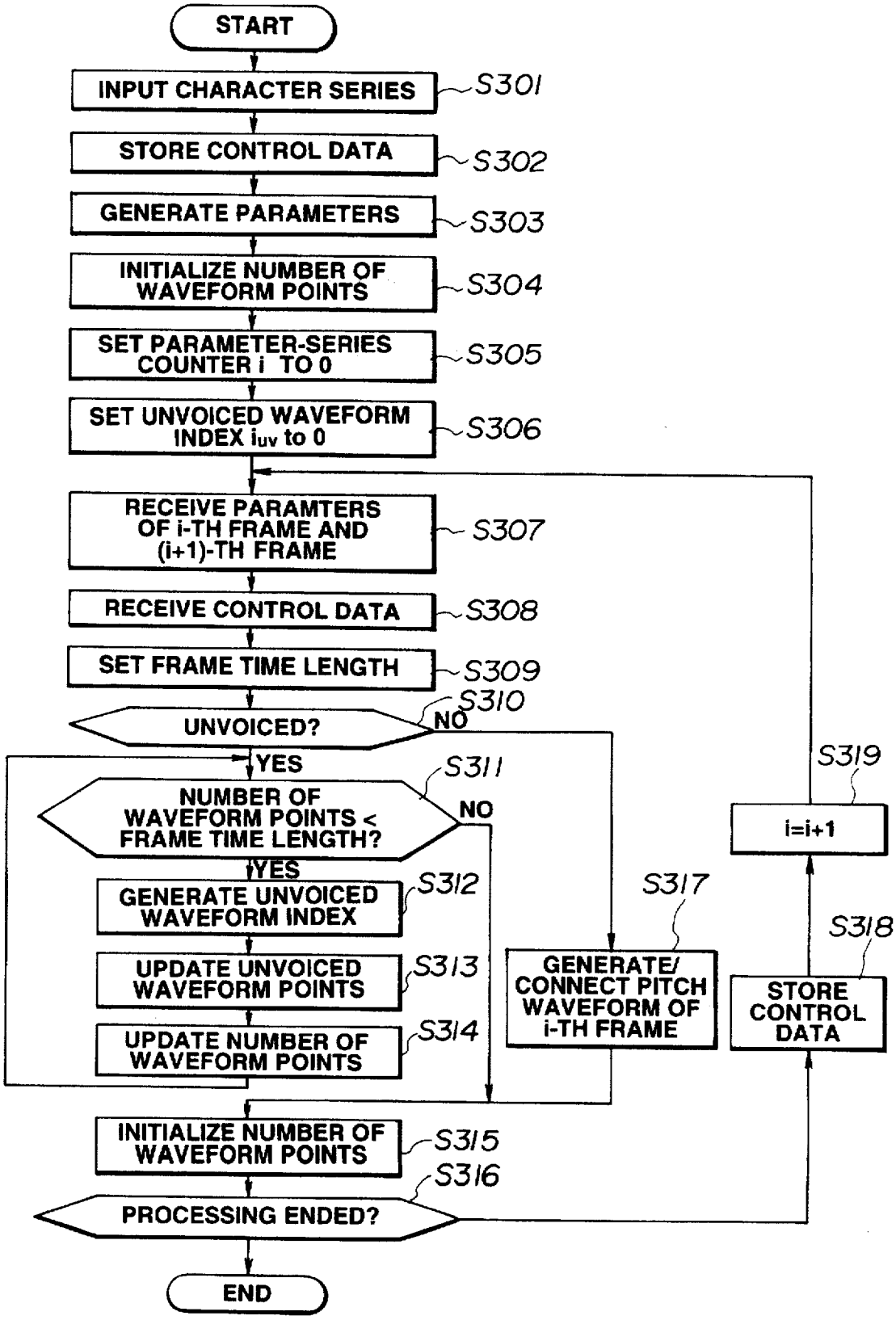
FIG. 15 is a flowchart illustrating the processing for generating a speech waveform.

The above-described operation will now be explained with reference to the flowchart shown in FIG. 15.

In step S301, a phonetic text is input into the character-series input unit 301.

In step S302, control data (relating to the speed and the pitch of the speech) input from outside of the apparatus and control data in the input phonetic text are stored in the control-data storage unit 302.

In step S303, the parameter generation unit 303 generates a parameter series from the phonetic text input from the character-series input unit 301.

FIG. 16 illustrates the data structure for one frame of each parameter generated in step S303.

In step S304, the internal register of the waveform-point-number storage unit 306 is initialized to 0.

If the number of waveform points is represented by $n_w$, $n_w=0$.

In step S305, a parameter-series counter i is initialized to 0.

In step S306, the unvoiced waveform index $i_{uv}$ is initialized to 0.

In step S307, parameters of the i-th frame and the (i+1)-th frame are transmitted from the parameter generation unit 303 into the internal register of the parameter storage unit 304.

In step S308, the speech speed data is transmitted from the control-data storage unit 302 into the frame-time-length setting unit 305.

In step S309, the frame-time-length setting unit 305 sets the frame time length Ni using the speech-speed coefficients received in the parameter storage unit 304, and the speech speed data received from the control-data storage unit 302.

In step S310, whether or not the parameter of the i-th frame corresponds to an unvoiced waveform is determined by the CPU 103 using voice/unvoiced information stored in the parameter storage unit 304. If the result of the determination is affirmative, a uvflag (unvoiced flag) is set by the CPU 103 and the process proceeds to step S311. If the result of the determination is negative, the process proceeds to step S317.

In step S311, the CPU 103 determines whether or not the number of waveform points nw is less than the frame time length Ni. If $n_w>Ni$, the process proceeds to step S315. If $n_w<Ni$, the process proceeds to step S312, and the processing is continued.

In step S312, the waveform generation unit 309 generates unvoiced waveforms using the synthesis parameter $p_i[m]$ ($0\leqq m<M$) of the i-th frame input from the synthesis-parameter interpolation unit 307. The power-normalized coefficient $C_{uv}$ and the unvoiced-waveform generation matrix $UVWGM(s)(i_{uv})=(c(i_{uv},m))(0\leqq m<M)$ are read from the table, and unvoiced waveforms are generated using the following expression:

$$w_{uv}(i_{uv}) = C_{uv} \sum_{m=0}^{M-1} c(i_{uv},m)p(m).$$

If a speech waveform output from the waveform generation unit 309 as synthesized speech is expressed by:

W(n) ($0\leqq n$), connection of unvoiced waveforms is performed according to $$W(n_w + 1) = w_{uv}(i_{uv})\ (i = 0)$$

$$W\left(\sum_{j=0}^{i-1} N_j + n_w + k\right) = w_{uv}(i_{uv})\ (i > 0),$$

where $N_j$ is the frame time length of the j-th frame.

In step S313, the number of unvoiced waveform points $N_{uv}$ is read from the table, and the unvoiced waveform index is updated as:

$$i_{uv}=(i_{uv}+1) \bmod N_{uv}.$$

In step S314, the waveform-point-number storage unit 306 updates the number of waveform points $n_w$ as $n_w=n_w+1$.

Then, the process returns to step S311, and the processing is continued.

When the voice/unvoiced information indicates a voiced waveform in step S310, the process proceeds to step S317, where the pitch waveform of the i-th frame is generated and connected. The processing performed in this step is the same as the processing performed in steps S9, S10, S11, S12 and S13 in the first embodiment.

If $n_w\geqq N_i$ in step S311, the process proceeds to step S315, and the number of waveform points is initialized as:

$$n_w=n_w-N_i.$$

In step S316, the CPU 103 determines whether or not all frames have been processed. If the result of the determination is negative, the process proceeds to step S318.

In step S318, control data (relating to the speed and the pitch of the speech) input from the outside is stored in the control-data storage unit 302. In step S319, the parameter-series counter i is updated as:

$$i=i+1.$$

Then, the process returns to step S307, and the processing is continued.

When the CPU 103 determines in step S316 that all frames have been processed, the processing is terminated.

Fourth Embodiment

In a fourth embodiment of the present invention, a description will be provided of a case in which processing can be performed with different sampling frequencies in an analyzing operation and in a synthesizing operation.

As in the case of the first embodiment, FIGS. 25 and 1 are block diagrams illustrating the configuration and the functional configuration of a speech synthesis apparatus according to the fourth embodiment, respectively.

A description will now be provided of the generation of pitch waveforms by the waveform generation unit 9.

Synthesis parameters used for generating pitch waveforms are expressed by p(m) ($0\leqq m<M$). The sampling frequency of impulse response waveforms, serving as synthesis parameters, is made an analysis sampling frequency represented by $f_s$. Then, the analysis sampling period is expressed by:

$$T_{s1}=1/f_{s1}.$$

If the pitch frequency of a synthesized speech is represented by f, the pitch period is expressed by:

$$T=1/f,$$

and the number of analysis pitch period points is expressed by:

$$N_{p1}(f)=f_{s1}T=T/T_{s1}=f_{s1}/f.$$

The number of analysis pitch period points quantized by an integer is expressed by:

$$N_{p1}(f)=[f_{s1}/f],$$

where [x] is the maximum integer equal to or less than x.

The sampling frequency of the synthesized speech is made a synthesis sampling frequency represented by $f_{s2}$. The number of synthesis pitch period points is expressed by $$N_{p2}(f)=f_{s2}/f,$$

which is quantized as:

$$N_{p2}(f)=[f_{s2}/f].$$

An angle $\theta_1$ for each pitch period point when the number of analysis pitch period points is made to correspond to an angle $2\pi$ is expressed by:

$$\theta_1=2\theta/N_{p1}(f).$$

The values of spectrum envelopes at integer multiples of the pitch frequency are expressed by:

$$e(l)=\sum_{m=0}^{M-1} p(m)\cos(ml\theta_1)\ (1>l\leqq[N_{p1}(f)/2]).$$

An angle $\theta_2$ for each pitch period point when the number of synthesis pitch period points is made to correspond to $2\pi$ is expressed by:

$$\theta_2=2\pi/N_{p2}(f).$$

If the pitch waveforms are expressed by:

$w(k)$ $(0<k\leqq N_{p2}(f))$, a power-normalized coefficient corresponding to the pitch frequency f is given by:

$$C(f)=\sqrt{f/f_0}\ ,$$

where $f_0$ is the pitch frequency at which $C(f)=1.0$.

By superposing sine waves of interger multiples of the pitch frequency, the pitch waveforms $w(k)$ $(0\leqq k<N_{p2}(f))$ are generated as:

$$w(k)=C(f)\sum_{l=1}^{[N_{p2}(f)/2]} e(l)\sin(lk\theta_2) \tag{8}$$

$$w(k)=C(f)\sum_{l=1}^{[N_{p2}(f)/2]} \sin(lk\theta_2)\sum_{m=0}^{M-1} p(m)\cos(ml\theta_1)$$

$$w(k)=C(f)\sum_{m=0}^{M-1} p(m)\sum_{l=1}^{[N_{p2}(f)/2]} \sin(lk\theta_2)\cos((ml\theta_1).$$

In this embodiment all summations over l are taken from $l=1$ to $l=[N_{p2}(f)/2]$ Alternatively, by superposing sine waves of interger multiples of the pitch frequency while shifting them by half the phase of the pitch period, the pitch waveforms $w(k)$ $(0\leqq k<N_{p2}(f))$ are generated as:

$$w(k)=C(f)\sum_{l=1}^{[N_{p2}(f)/2]} e(l)\sin(l(k\theta_2+\pi)) \tag{9}$$

$$w(k)=C(f)\sum_{l=1}^{[N_{p2}(f)/2]} \sin(l(k\theta_2+\pi))\sum_{m=0}^{M-1} p(m)\cos(ml\theta_1)$$

$$w(k)=C(f)\sum_{m=0}^{M-1} p(m)\sum_{l=1}^{[N_{p2}(f)/2]} \sin(l(k\theta_2+\pi))\cos(ml\theta_1).$$

A pitch scale is used as a scale for representing the pitch of speech. Instead of directly performing the calculation of expressions (8) and (9), the speed of calculation can be increased in the following manner. That is, if the number of analysis pitch period points, and the number of synthesis pitch period points corresponding to a pitch scale $s\epsilon S$ (S being a set of pitch scales) are represented by $N_{p1}(s)$, and $N_{p2}(s)$, respectively, and $$\theta_1=2\pi/N_{p1}(s)$$
$$\theta_2=2\pi/N_{p2}(s),$$

-continued $$c_{km}(s)=\sum_{l=1}^{[N_{p2}(f)/2]} \sin(lk\theta_2)\cos(ml\theta_1)$$

for expression (8), and $$c_{km}(s)=\sum_{l=1}^{[N_{p2}(f)/2]} \sin(l(k\theta_2+\pi))\cos(ml\theta_1)$$

for expression (9), are calculated, and the results of the calculation are stored in a table. A waveform generation matrix is expressed as:

$$WGM(s)=(C_{km}(s))\ (0\leqq k<N_{p2}(s),\ 0<m<M).$$

The number of synthesis pitch period points $N_{p2}(s)$ and the power-normalized coefficient C(s) corresponding to the pitch scale s are also stored in the table.

The waveform generation unit 9 reads the number of synthesis pitch period points $N_{p2}(s)$, the power-normalized coefficient C(s) and the waveform generation matrix WGM $(s)=(C_{km}(s))$ from the table while using the synthesis parameters p(m) $(0\leqq m<M)$ output from the synthesis-parameter interpolation unit 7 and the pitch scale s output from the pitch-scale interpolation unit 8 as inputs, and generates pitch waveforms according to:

$$w(k)=C(s)\sum_{m=0}^{M-1} c_{km}(s)p(m)\ (0\leqq k<N_{p2}(s)).$$

The above-described operation will be explained with reference to the flowchart shown in FIG. 7.

The processing of steps S1, S2, S3, S4, S5, S6, S7, S8, S9, S10 and S11 is the same as in the first embodiment.

A description will now be provided of the processing of generating pitch waveforms in step S12 in the present embodiment. The waveform generation unit 9 generates pitch waveforms using the synthesis parameters p[m] $(0<m<M)$ obtained from expression (3) and the pitch scale s obtained from expression (4). The number of synthesis pitch period points $N_{p2}(s)$, the power-normalized coefficient C(s) and the waveform generation matrix $WGM(s)=(c_{km}(s))$ $(0\leqq k<N_{p2},\ 0<m\leqq M)$ corresponding to the pitch scale s are read from the table, and pitch waveforms are generated using the following expression:

$$w(k)=C(s)\sum_{m=0}^{M-1} c_{km}(s)p(m)\ (0\leqq k<N_{p2}(s)).$$

If a speech waveform output from the waveform generation unit 9 as synthesized speech is expressed by:

$W(n)$ $(0\leqq n)$, the connection of the pitch waveforms is performed according to $$W(n_w+k)=w(k)\ (i=0,\ 0\leqq k<N_{p2}(s))$$

$$W\left(\sum_{j=0}^{i-1} N_j+n_w+k\right)=w(k)\ (i>0,\ 0\leqq k<N_{p2}(s)),$$

where $N_j$ is the frame time length of the j-th frame.

In step S13, the waveform-point-number storage unit 6 updates the number of waveform points $n_w$ as $$n_w=n_w+N_{p2}(s).$$

The processing performed in steps S14, S15, S16 and S17 is the same as that in the first embodiment.

Fifth Embodiment

In a fifth embodiment of the present invention, a description will be provided of a case in which by generating pitch waveforms from power spectrum envelopes, parameters can be operated in the frequency range utilizing the power spectrum envelopes.

As in the case of the first embodiment, FIGS. 25 and 1 are block diagrams illustrating the configuration and the functional configuration of a speech synthesis apparatus according to the fifth embodiment, respectively.

A description will now be provided of the generation of pitch waveforms by the waveform generation unit 9.

First, a description will be provided of synthesis parameters used for generating pitch waveforms. In FIGS. 17A–17D, N represents the degree of Fourier transform, and M represents the degree of impulse response waveforms used for generating pitch waveforms. N and M are arranged to satisfy the relationship of $N \geqq 2M$. Logarithmic power spectrum envelopes of speech are expressed by:

$$a(n)=A(2\pi n/N)\ (0 \leqq n<N).$$

Figure 17A:
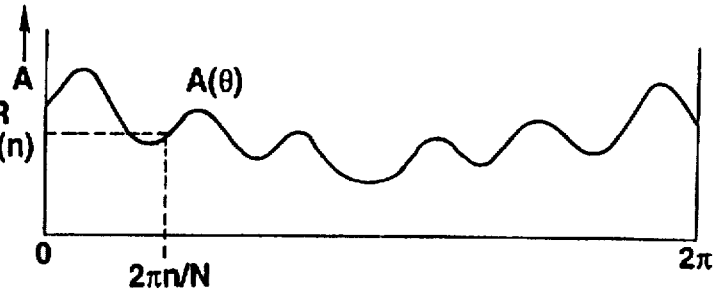
FIGS. 17A–17D are graphs illustrating synthesis parameters.

One such envelope is shown in FIG. 17A.

Impulse responses obtained by inputting the logarithmic power spectrum envelopes into exponential functions to be returned to a linear form, and performing an inverse Fourier transform are expressed by:

$$h(m) = 1/N \sum_{n=0}^{N-1} \exp(a(n))\cos(2\pi nm/N)\ (0 \leqq m < N).$$

Figure 17B:
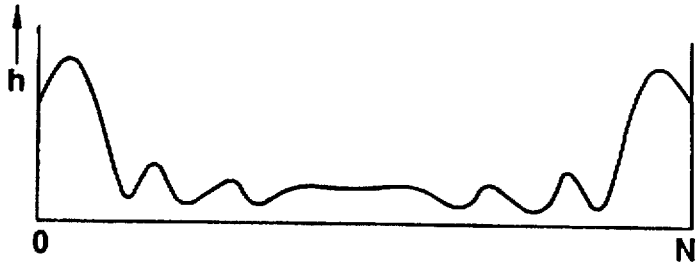

One such response function is shown in FIG. 17B.

Impulse response waveforms h'(m) ($0 \leqq m<M$) used for generating pitch waveforms can be obtained by doubling the values of the first degree and the subsequent degrees of the impulse responses relative to the value of the 0 degree. That is, with the condition of $r \neq 0$, $$h'(0)=rh(0)$$

$$h'(m)=2rh(m)\ (1 \leqq m<M).$$

Figure 17C:
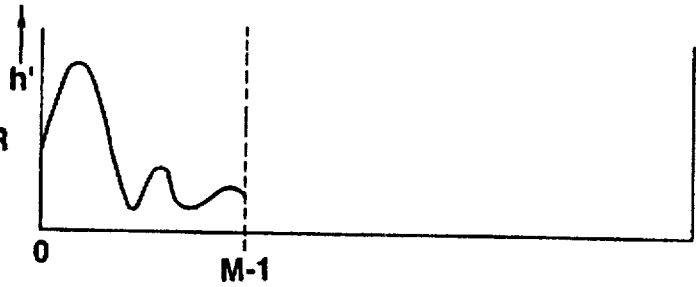

One such impulse response waveform is shown in FIG. 17C.

Figure 17D:
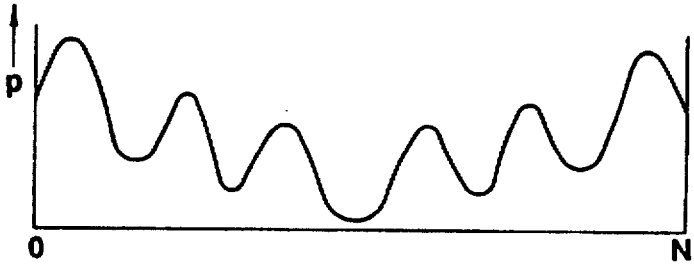

Synthesis parameters are expressed by:

$p(n)=r\cdot\exp(a(n))$ ($0 \leqq n<N$), and $r \neq 0$, as shown in FIG. 17D.

Then, the following expressions are obtained:

$$h'(m) = 1/N \sum_{n=0}^{N-1} p(n)\ (m = 0)$$

$$h'(m) = 2/N \sum_{n=0}^{N-1} p(n)\cos(2\pi nm/N)\ (1 \leqq m < M).$$

$$b_{mn} = \begin{cases} 1/N \text{ when } (m = 0, 0 < n < N) \\ (2/N)\cos(2\pi nm/N) \\ \text{when } (1 \leqq m < M, 0 \leqq n < N), \end{cases}$$

and the following expression is obtained:

$$h'(m) = \sum_{n=0}^{N-1} b_{mn}p(n)\ (0 \leqq m < M).$$

If the sampling frequency is expressed by $f_s$, the sampling period is expressed by:

$$T_s=1/f_s.$$

If the pitch frequency of synthesized speech is represented by f, the pitch period is expressed by:

$$T=1/f,$$

and the number of pitch period points is expressed by:

$$N_p(f)=f_sT=T/T_s=f_s/f.$$

By quantizing the number of pitch period points with an integer, the following expression is obtained:

$$N_p(f)=[f_s/f],$$

where [x] represents the maximum integer equal to or less than x.

An angle θ for each pitch period point when the pitch period is made to correspond to an angle 2π is expressed by:

$$\theta=2\pi/N_p(f).$$

The values of spectrum envelopes at integer multiples of the pitch frequency are expressed by:

$$e(l) = \sum_{m=0}^{M-1} h'(m)\cos(ml\theta)\ (1 \leqq l \leqq [N_p(f)/2])$$

$$e(l) = \sum_{m=0}^{M-1} \sum_{n=0}^{N-1} b_{mn}p(n)\cos(ml\theta)\ (1 \leqq l \leqq [N_p(f)/2])$$

$$e(l) = \sum_{n=0}^{N-1} p(n) \sum_{m=0}^{M-1} b_{mn}\cos(ml\theta)\ (1 \leqq l \leqq [N_p(f)/2].$$

If the pitch waveforms are expressed by:

$w(k)$ ($0 \leqq k<N_p(f)$), a power-normalized coefficient C(f) corresponding to the pitch frequency f is given by:

$$C(f) = \sqrt{f/f_0}\ ,$$

where $f_0$ is the pitch frequency at which C(f)=1.0.

By superposing sine waves of interger multiples of the fundamental frequency, the pitch waveforms w(k) ($0 \leqq k<N_p(f)$) are generated as:

$$w(k) = C(f) \sum_{l=1}^{[N_p(f)/2]} e(l)\sin(lk\theta) \tag{10}$$

$$w(k) = C(f) \sum_{l=1}^{[N_p(f)/2]} \sin(lk\theta) \sum_{n=0}^{N-1} p(n) \sum_{m=0}^{M-1} b_{mn}\cos(ml\theta)$$

$$w(k) = C(f) \sum_{n=0}^{N-1} p(n) \sum_{m=0}^{M-1} b_{mn} \sum_{l=1}^{[N_p(f)/2]} \sin(lk\theta)\cos(ml\theta).$$

In this embodiment all the summations over l are taken from l=1 to $l=[N_p(f)/2]$.

Alternatively, by superposing sine waves of interger multiples of the fundamental frequency while shifting them by half the phase of the pitch period, the pitch waveforms w(k) ($0 \leqq k<N_p(f)$) are generated as:

$$w(k) = C(f) \sum_{l=1}^{[N_p(f)/2]} e(l)\sin(l(k\theta + \pi)) \tag{11}$$

$$w(k) = C(f) \sum_{l=1}^{[N_p(f)/2]} \sin(l(k\theta + \pi)) \sum_{n=0}^{N-1} p(n) \sum_{m=0}^{M-1} b_{mn}\cos(ml\theta)$$

-continued $$w(k) = C(f) \sum_{n=0}^{N-1} p(n) \sum_{m=0}^{M-1} b_{mn} \sum_{l=1}^{[N_p(f)/2]} \sin(l(k\theta + \pi))\cos(ml\theta).$$

A pitch scale is used as a scale for representing the pitch of speech. Instead of directly performing the calculation of expressions (10) and (11), the speed of calculation can be increased in the following manner. That is, if $\theta=2\pi/N_p(s)$, where $N_p(s)$ is the number of pitch period points corresponding to the pitch scale s, terms $$c_{kn}(s) = \sum_{m=0}^{M-1} b_{mn} \sum_{l=1}^{[N_p(f)/2]} \sin(lk\theta)\cos(ml\theta)$$

for expression (10), and $$c_{kn}(s) = \sum_{m=0}^{M-1} b_{mn} \sum_{l=1}^{[N_p(f)/2]} \sin(l(k\theta + \pi))\cos(ml\theta)$$

for expression (11) are calculated and the results of the calculation are stored in a table.

A waveform generation matrix is expressed as:

$$WGM(s)=(c_{kn}(s)) \ (0 \leqq k < N_p(s),\ 0 \leqq n < M).$$

In addition, the number of pitch period points $N_p(s)$ and the power-normalized coefficient C(s) corresponding to the pitch scale s are stored in the table.

The waveform generation unit 9 reads the number of pitch period points $N_p(s)$, the power-normalized coefficient C(s) and the waveform generation matrix $WGM(s)=(C_{kn}(s))$ from the table while using the synthesis parameters p(n) ($0 \leqq n < N$) output from the synthesis-parameter interpolation unit 7 and the pitch scale s output from the pitch-scale interpolation unit 8 as inputs, and generates pitch waveforms according to:

$$w(k) = C(s) \sum_{n=0}^{N-1} c_{kn}(s)p(n) \ (0 \leqq k < N_p(s))$$

Figure 18:
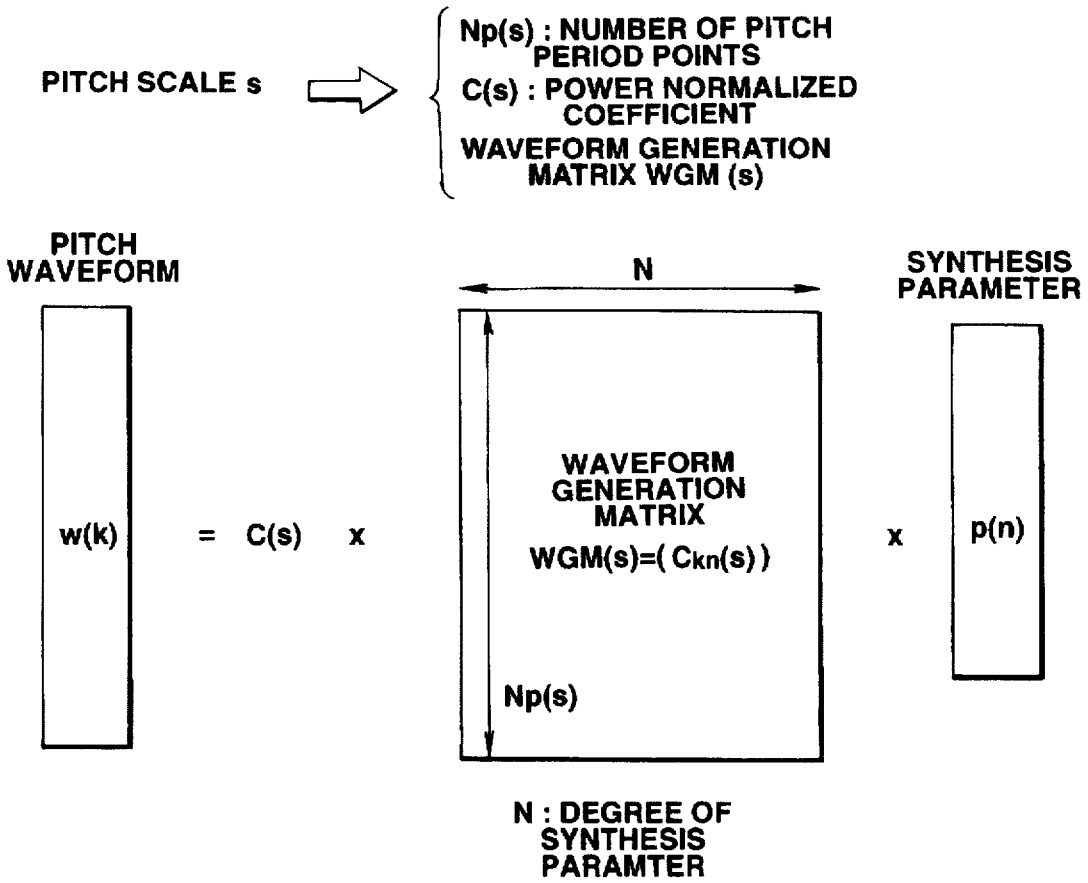
FIG. 18 is a schematic diagram illustrating a method of generating pitch waveforms.

(see FIG. 18).

The above-described operation will now be explained with reference to the flowchart shown in FIG. 7.

The processing performed in steps S1, S2 and S3 is the same as that in the first embodiment.

FIG. 19 illustrates the data structure for one frame of each parameter generated in step S3.

The processing performed in steps S4, S5, S6, S7, S8 and S9 is the same as that in the first embodiment.

Figure 20:
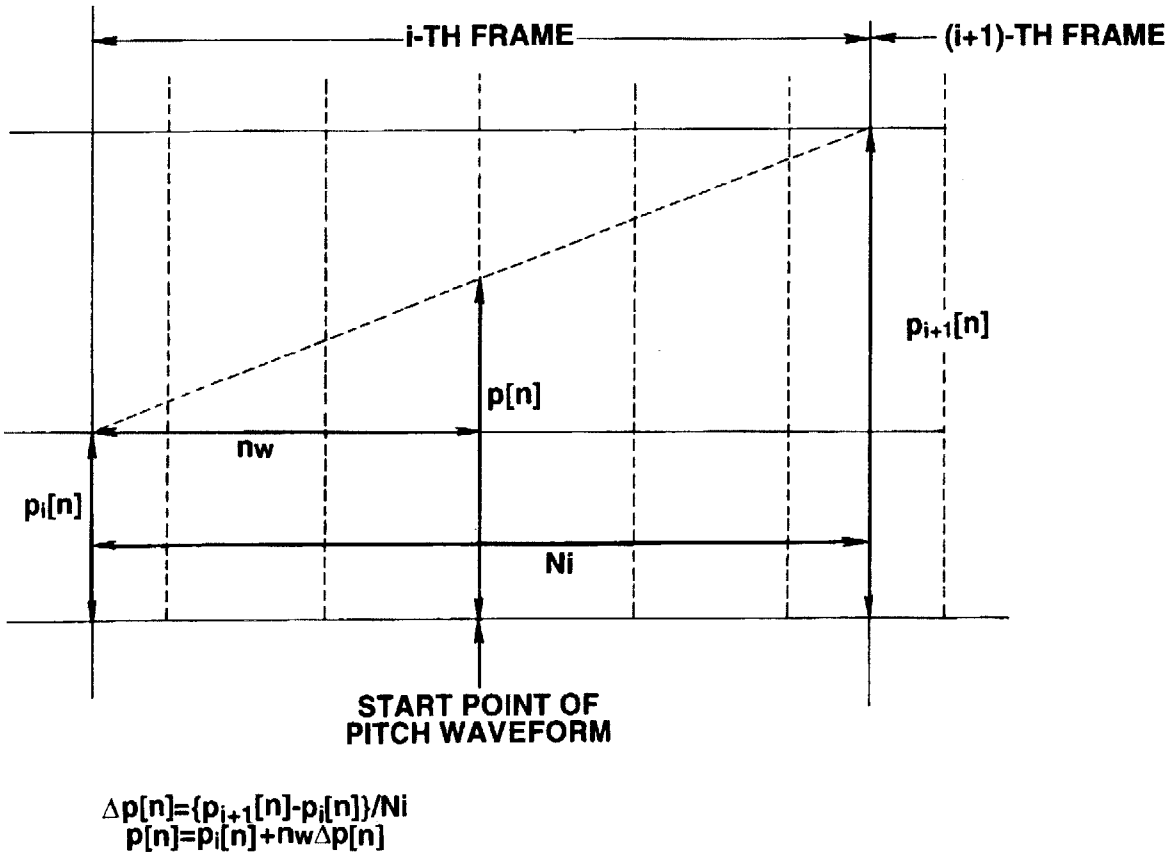
FIG. 20 is a schematic diagram illustrating the interpolation of synthesis parameters.

In step S10, the synthesis-parameter interpolation unit 7 interpolates synthesis parameters using synthesis parameters received from the parameter storage unit 4, the frame time length set by the frame-time-length setting unit 5, and the number of waveform points stored in the waveform-point-number storage unit 6. FIG. 20 illustrates interpolation of synthesis parameters. If synthesis parameters of the i-th frame and the (i+1)-th frame are represented by $p_i[n]$ ($0 \leqq n < N$) and $p_{i+1}[n]$ ($0 \leqq n < N$), respectively, and the time length of the i-th frame equals $N_i$ points, the difference $\Delta p[n]$ ($0 \leqq n < N$) between synthesis parameters per point is expressed by:

$$\Delta p[n]=(p_{i+1}[n]-p_i[n])/N_i.$$

The synthesis parameters p[n] ($0 \leqq n < N$) are updated every time a pitch waveform is generated.

The processing of $$p[n]=p_i[n]+n_w\Delta p[n] \tag{12}$$

is performed at the start point of the pitch waveform.

The processing of step S11 is the same as in the first embodiment.

In step S12, the waveform generation unit 9 generates pitch waveforms using the synthesis parameters p[n] ($0 \leqq n < N$) obtained from expression (12) and the pitch scale s obtained from expression (4). The number of pitch period points $N_p(s)$, the power-normalized coefficients C(s) and the waveform generation matrix $WGM(s)=(c_{kn}(s))$ ($0 \leqq k < N_p(s)$, $0 \leqq n < N$) corresponding to the pitch scale s are read from the table, and the pitch waveforms are generated using the following expression:

$$w(k) = C(s) \sum_{n=0}^{N-1} c_{kn}(s)p(n) \ (0 \leqq k < N_p(s)).$$

FIG. 11 is a diagram illustrating connection of the generated pitch waveforms. If a speech waveform output from the waveform generation unit 9 as synthesized speech is expressed by:

W(n) ($0 \leqq n$), the connection of the pitch waveforms is performed according to $$W(n_w + k) = w(k) \ (i = 0,\ 0 \leqq k < N_p(s))$$

$$W\left(\sum_{j=0}^{i-1} N_j + n_w + k\right) = w(k) \ (i > 0,\ 0 \leqq k < N_p(s)),$$

where $N_j$ is the frame time of the j-th frame.

The processing of steps S13, S14, S15, S16 and S17 is the same as in the first embodiment.

Sixth Embodiment

In a sixth embodiment of the present invention, a description will be provided of a case in which spectrum envelopes are converted using a function for determining frequency characteristics.

As in the case of the first embodiment, FIGS. 25 and 1 are block diagrams illustrating the configuration and the functional configuration of a speech synthesis apparatus according to the sixth embodiment, respectively.

A description will now be provided of the generation of pitch waveforms by the waveform generation unit 9.

Synthesis parameters used for generating pitch waveforms are expressed by p(m) ($0 \leqq m < M$). If the sampling frequency is represented by $f_s$, the sampling period is expressed by:

$$T_s=1/f_s.$$

If the pitch frequency of synthesized speech is represented by f, the pitch period is expressed by:

$$T=1/f,$$

and the number of pitch period points is expressed by:

$$N_p(f)=f_sT=T/T_s=f_s/f.$$

The number of pitch period points quantized by an integer is expressed by:

$$N_p(f)=[f_s/f],$$

where [x] is the maximum integer equal to or less than x.

An angle θ for each point when the number of pitch period points is made to correspond to an angle 2π is expressed by:

$$\theta=2/N_p(f).$$

The values of spectrum envelopes at integer multiples of the pitch frequency are expressed by:

$$e(l)=\sum_{n=0}^{M-1} p(m)\cos(ml\theta)\ (1 \leqq l \leqq [N_p(f)/2]).$$

A frequency-characteristics function used in the operation of spectrum envelopes is expressed by:

$r(x)$ $(0 \leqq x \leqq f_s/2)$.

Figure 21:
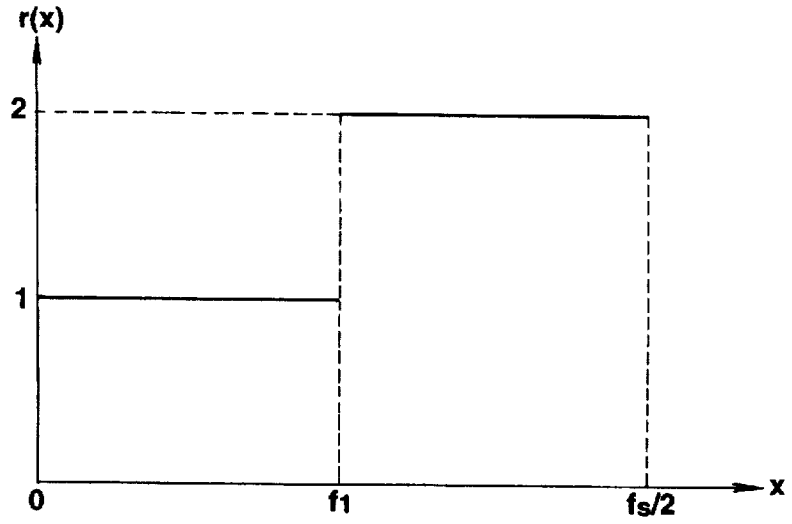
FIG. 21 is a graph illustrating a frequency characteristics function.

FIG. 21 illustrates the case of doubling the amplitude of each harmonic having a frequency equal to or higher than $f_1$. By changing r(x), spectrum envelopes can be operated upon. Using this function, the values of spectrum envelopes at integer multiples of the pitch frequency are converted as:

$$r(lf)e(l)=r(lf)\sum_{m=0}^{M-1} p(m)\cos(ml\theta)\ (1 \leqq l \leqq [N_p(f)/2])$$

If the pitch waveforms are expressed by:

$w(k)$ $(0 \leqq k < N_p(f))$, a power-normalized coefficient corresponding to the pitch frequency f is given by:

$$C(f)=\sqrt{ff_0}\ ,$$

where $f_0$ is the pitch frequency at which C(f)=1.0.

By superposing sine waves of integer multiples of the fundamental frequency, the pitch waveforms w(k) $(0 \leqq k < N_p(f))$ are generated as:

$$w(k)=C(f)\sum_{l=1}^{[N_p(f)/2]} r(lf)e(l)\sin(lk\theta) \tag{13}$$

$$w(k)=C(f)\sum_{l=1}^{[N_p(f)/2]} \sin(lk\theta)r(lf)\sum_{m=0}^{M-1} p(m)\cos(ml\theta)$$

$$w(k)=C(f)\sum_{m=0}^{m-1} p(m)\sum_{l=1}^{[N_p(f)/2]} r(lf)\sin(lk\theta)\cos(ml\theta).$$

In this embodiment all the summations over l are taken from l=1 to $l=[N_p(f)/2]$.

Alternatively, by superposing sine waves of interger multiples of the fundamental frequency while shifting them by half the phase of the pitch period, the pitch waveforms w(k) $(0 \leqq k < N_p(f))$ are generated as:

$$w(k)=C(f)\sum_{l=1}^{[N_p(f)/2]} r(lf)e(l)\sin(l(kn\theta+\pi)) \tag{14}$$

$$w(k)=C(f)\sum_{l=1}^{[N_p(f)/2]} \sin(l(k\theta+\pi))r(lf)\sum_{m=0}^{M-1} p(m)\cos(ml\theta)$$

$$w(k)=C(f)\sum_{m=0}^{M-1} p(m)\sum_{l=1}^{[N_p(f)/2]} r(lf)\sin(l(kn\theta+\pi))\cos(ml\theta).$$

A pitch scale is used as a scale for representing the pitch of speech. Instead of directly performing the calculation of expressions (13) and (14), the speed of calculation can be increased in the following manner. That is, if the pitch frequency, and the number of pitch period points corresponding to a pitch scale s are represented by f and $N_p(s)$, respectively, and $$\theta=2\pi N_p(s),$$

and the frequency-characteristics function is expressed by:

$r(x)$ $(0 \leqq x \leqq f_s/2)$, and $$c_{km}(s)=\sum_{l=1}^{[N_p(f)/2]} r(lf)\sin(lk0)\cos(ml0)$$

for expression (13), and $$c_{km}(s)=\sum_{l=1}^{[N_p(f)/2]} r(lf)\sin(l(k\theta+\pi))\cos(ml\theta)$$

for expression (14), are calculated, and the results of the calculation are stored in a table. A waveform generation matrix is expressed as:

$$WGM(s)=(c_{km}(s))\ (0 \leqq k < N_p,\ 0 \leqq m < M).$$

The number of pitch period points $N_p$ and the power-normalized coefficient C(s) corresponding to the pitch scale s are also stored in the table.

The waveform generation unit 9 reads the number of pitch period points $N_p(s)$, the power-normalized coefficient C(s) and the waveform generation matrix $WGM(s)=(c_{km}(s))$ from the table while using the synthesis parameters p(m) (0<m<M) output from the synthesis-parameter interpolation unit 7 and the pitch scale s output from the pitch-scale interpolation unit 8 as inputs, and generates pitch waveforms according to:

$$w(k)=C(s)\sum_{m=0}^{M-1} c_{km}(s)p(m)\ (0 \leqq k < N_p(s))$$

(see FIG. 6).

The above-described operation will be explained with reference to the flowchart shown in FIG. 7.

The processing of steps S1, S2, S3, S4, S5, S6, S7, S8, S9, S10 and S11 is the same as in the first embodiment.

In step S12, the waveform generation unit 9 generates pitch waveforms using the synthesis parameters p[m] $(0 \leqq m < M)$ obtained from expression (3) and the pitch scale s obtained from expression (4). The number of pitch period points $N_p(s)$, the power-normalized coefficient C(s) and the waveform generation matrix $WGM(s)=(c_{km}(s))$ $(0 \leqq k < N_p(s),\ 0 \leqq m < M)$ corresponding to the pitch scale s are read from the table, and the pitch waveforms are generated using the following expression:

$$w(k)=C(s)\sum_{m=0}^{M-1} c_{km}(s)p(m)\ (0 \leqq k < N_p(s)).$$

FIG. 11 is a diagram illustrating the connection of the generated pitch waveforms. If a speech waveform output from the waveform generation unit 9 as a synthesized speech is expressed by:

$W(n)$ $(0 \leqq n)$, the connection of the pitch waveforms is performed according to $$W(n_w + k) = w(k)\ (i = 0,\ 0 \leqq k < N_p(s))$$

$$W\left(\sum_{j=0}^{i-1} N_j + n_w + k\right) = w(k)\ (i > 0,\ 0 \leqq k < N_p(s)),$$

where $N_j$ is the frame time length of the j-th frame.

The processing performed in steps S13, S14, S15, S16 and S17 is the same as that in the first embodiment.

Seventh Embodiment

In a seventh embodiment of the present invention, a description will be provided of a case of using cosine functions instead of the sine functions used in the first embodiment.

As in the case of the first embodiment, FIGS. 25 and 1 are block diagrams illustrating the configuration and the functional configuration of a speech synthesis apparatus according to the seventh embodiment, respectively.

A description will now be provided of the generation of pitch waveforms by the waveform generation unit 9.

Synthesis parameters used for generating pitch waveforms are expressed by p(m) ($0 \leqq m < M$). If the sampling frequency is represented by $f_s$, the sampling period is expressed by:

$$T_s = 1/f_s.$$

If the pitch frequency of synthesized speech is represented by f, the pitch period is expressed by:

$$T = 1/f,$$

and the number of pitch period points is expressed by:

$$N_p(f) = f_s T = T/T_s = f_s/f.$$

The number of pitch period points quantized by an integer is expressed by:

$$N_p(f) = [f_s/f],$$

where [x] is the maximum integer equal to or less than x.

An angle θ for each point when the number of pitch period points is made to correspond to an angle 2π is expressed by:

$$\theta = 2/N_p(f).$$

The values of spectrum envelopes at integer multiples of the pitch frequency are expressed by:

$$e(l) = \sum_{m=0}^{M-1} p(m)\cos(ml\theta)\ (1 \leqq l \leqq [N_p(f)/2]$$

Figure 3:
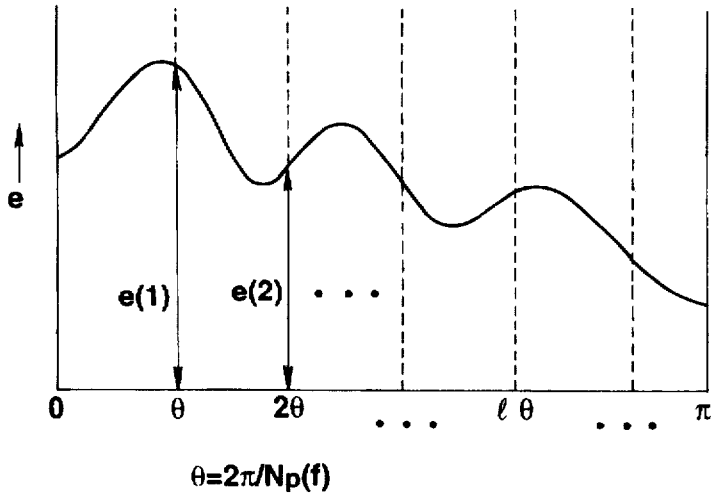
FIG. 3 is a graph illustrating spectrum envelopes used in the embodiments.

(see FIG. 3).

If the pitch waveforms are expressed by:

w(k) ($0 \leqq k < N_p(f)$), a power-normalized coefficient corresponding to the pitch frequency f is given by:

$$C(f) = \sqrt{f/f_0}\ ,$$

where $f_0$ is the pitch frequency at which C(f)=1.0.

By superposing cosine waves of interger multiples of the fundamental frequency, the pitch waveforms w(k) ($0 \leqq k < N_p(f)$) are generated as:

$$w(k) = C(f) \sum_{l=1}^{[N_p(f)/2]} e(l)\cos(lk\theta) \tag{15}$$

$$w(k) = C(f) \sum_{l=1}^{[N_p(f)/2]} \cos(lk\theta) \sum_{m=0}^{M-1} p(m)\cos(ml\theta)$$

$$w(k) = C(f) \sum_{m=0}^{M-1} p(m) \sum_{l=1}^{[N_p(f)/2]} \cos(lk\theta)\cos(ml\theta).$$

In this embodiment all the summations over l are taken from l=1 to $l=[N_p(f)/2]$ for the equations up to and including equation 16, while l varies from l=1 to $l=[N_p(s)/2]$ in the equations after equation (16).

If the pitch frequency of the next pitch waveform is represented by f', the value of the 0 degree of the next pitch waveform is expressed by:

$$w'(0) = C(f') \sum_{m=0}^{M-1} p(m) \sum_{l=1}^{[N_p(f)/2]} \cos(ml\theta).$$

The pitch waveforms w(k) ($0 \leqq k < N_p(f)$) are generated as:

$$w(k) = \Gamma(k)w(k),$$

where $$\Gamma_0 = w'(0)/w(0)$$

$$\Gamma(k) = 1 + (\Gamma - 1)/N_p(f) \cdot k\ (0 \leqq k < N_p(f))$$

Figure 22:
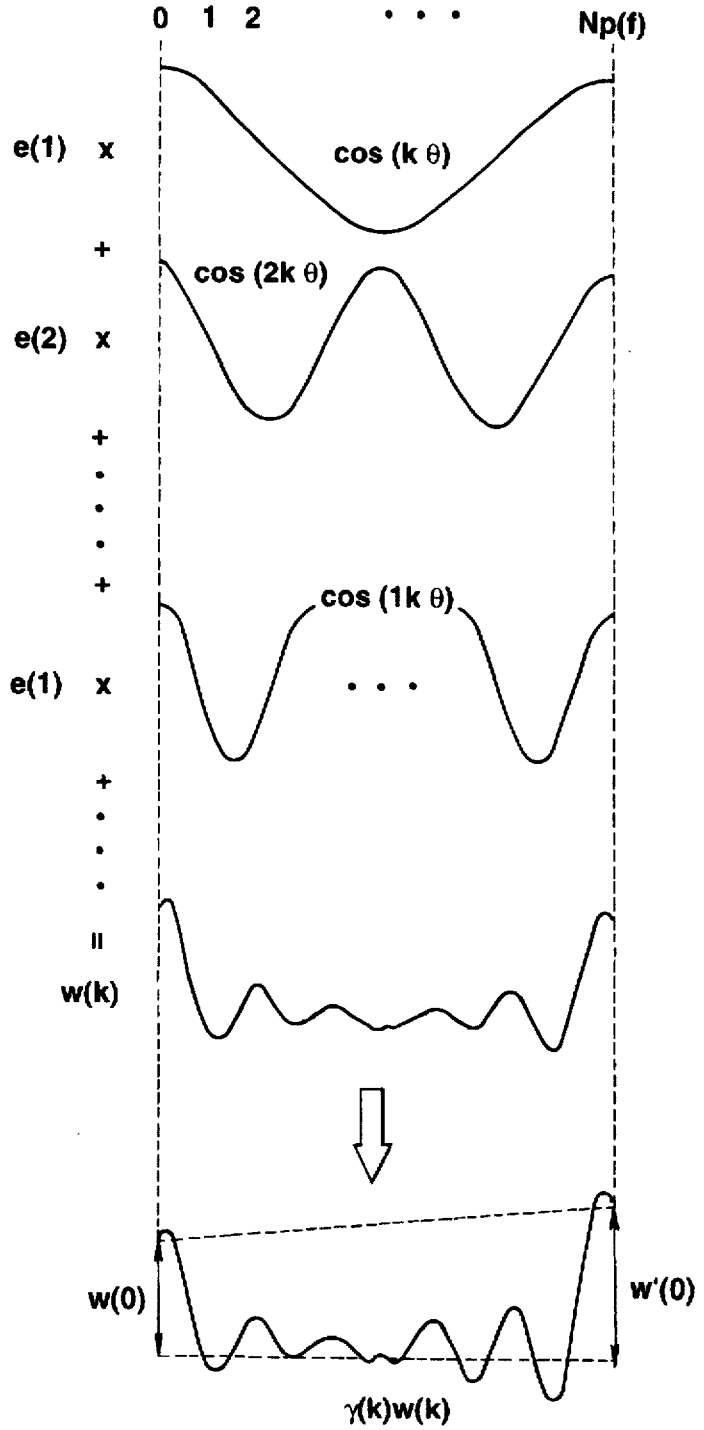
FIGS. 22 and 23 are graphs illustrating the superposition of cosine waves.

(see FIG. 22).

Thus, FIG. 22 shows separate cosine waves of integer multiples of the fundamental frequency cos (kθ), cos (2kθ), . . . , cos (lkθ) which are multipled by e(1), e(2), . . . , e(l), respectively, and added together to produce a pitch waveform w(k) generated as Γ(k)w(k) at the bottom of FIG. 22.

Alternatively, by superposing sine waves of interger multiples of the fundamental frequency while shifting them by half the phase of the pitch period, the pitch waveforms w(k) ($0 \leqq k < N_p(f)$) are generated as:

$$w(k) = C(f) \sum_{l=1}^{[N_p(f)/2]} e(l)\cos(l(k\theta + \pi)) \tag{16}$$

$$w(k) = C(f) \sum_{l=1}^{[N_p(f)/2]} \cos(l(k\theta + \pi)) \sum_{m=0}^{M-1} p(m)\cos(ml\theta)$$

$$w(k) = C(f) \sum_{m=0}^{M-1} p(m) \sum_{l=1}^{[N_p(f)/2]} \cos(l(k\theta + \pi))\cos(ml\theta).$$

Figure 23:
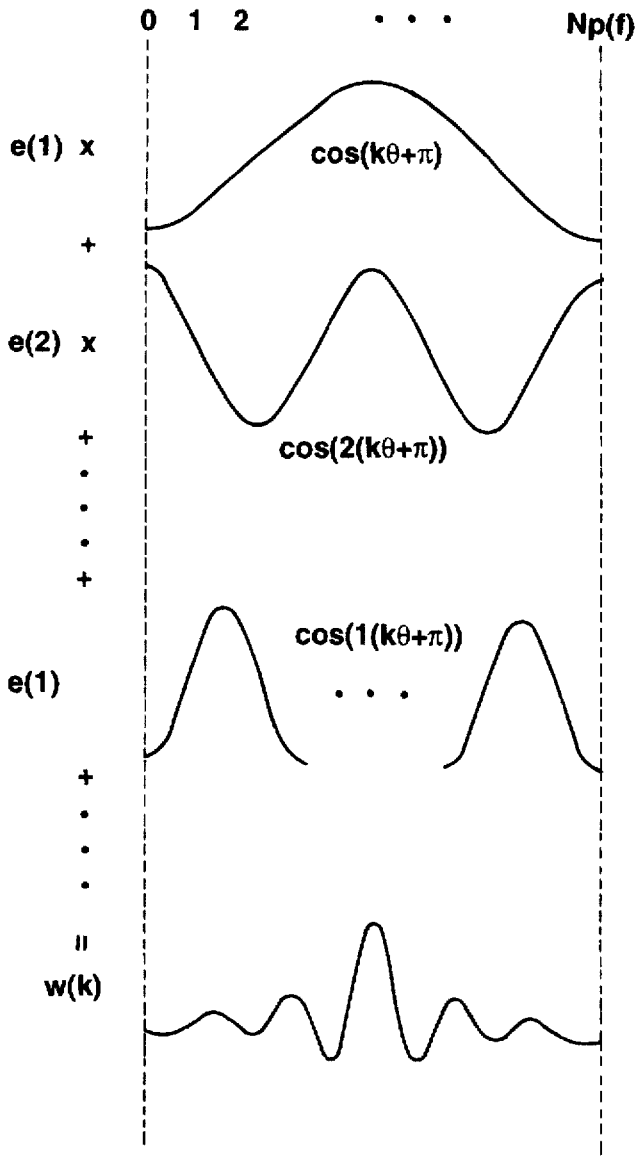

FIG. 23 shows this process. Specifically, FIG. 23 shows separate cosine waves of integer multiples of the fundamental frequency by half the phase of the pitch period cos (kθ+π), cos (2(kθ+π)), . . . , cos (l(kθ+π)) which are multiplied by e(1), e(2), . . . , e(l), respectively, and added together to produce the pitch waveform w(k) shown at the bottom of FIG. 23.

A pitch scale is used as a scale for representing the pitch of speech. Instead of directly performing the calculation of expressions (15) and (16), the speed of calculation can be increased in the following manner. That is, if the number of pitch period points corresponding to a pitch scale s are represented by $N_p(s)$, and $\theta = 2\pi/N_p(s)$, $$c_{km}(s) = \sum_{l=1}^{[N_p(f)/2]} \cos(lk\theta)\cos(ml\theta) \quad (17)$$

for expression (15), and $$c_{km}(s) = \sum_{l=1}^{[N_p(f)/2]} \cos(l(k\theta + \pi)\cos(ml\theta)$$

for expression (16) are calculated, and the results of the calculation are stored in a table. A waveform generation matrix is expressed as:

$$WGM(s)=(c_{km}(s)) \ (0 \leqq k < N_p, \ 0 \leqq m < M).$$

The number of pitch period points $N_p$ and the power-normalized coefficient C(s) corresponding to the pitch scale s are also stored in the table.

The waveform generation unit 9 reads the number of pitch period points $N_p(s)$, the power-normalized coefficient C(s) and the waveform generation matrix $WGM(s)=(c_{km}(s))$ from the table while using the synthesis parameters p(m) ($0 \leqq m < M$) output from the synthesis-parameter interpolation unit 7 and the pitch scale s output from the pitch-scale interpolation unit 8 as inputs, and generates pitch waveforms according to:

$$w(k) = C(s) \sum_{m=0}^{M-1} c_{km}(s)p(m) \ (0 \leqq k < N_p(s)).$$

When the waveform generation matrix has been calculated according to expression (17), $$w'(0) = C(s') \sum_{m=0}^{M-1} p(m) \sum_{l=1}^{[N_p(f)/2]} \cos(ml\theta)$$

$$\gamma_0 = w'(0)/w(0)$$
$$\gamma(k) = 1 + (\gamma_0 - 1)/N_p(s) \cdot k \ (0 \leqq k < N_p(s)),$$

where s' is the pitch scale of the next pitch waveform, and $$w(k)=\Gamma(k)w(k)$$

is made to be the pitch waveform.

The above-described operation will be explained with reference to the flowchart shown in FIG. 7.

The processing of steps S1, S2, S3, S4, S5, S6, S7, S8, S9, S10 and S11 is the same as in the first embodiment.

In step S12, the waveform generation unit 9 generates pitch waveforms using the synthesis parameters p[m] ($0 \leqq m < M$) obtained from expression (3) and the pitch scale s obtained from expression (4). The number of pitch period points $N_p(s)$, the power-normalized coefficient C(s) and the waveform generation matrix $WGM(s)=(c_{km}(s))$ ($0 \leqq k < N_p(s)$, $0 \leqq m < M$) corresponding to the pitch scale s are read from the table, and the pitch waveforms are generated using the following expression:

$$w(k) = C(s) \sum_{m=0}^{M-1} c_{km}(s)p(m) \ (0 \leqq k < N_p(s)).$$

When the waveform generation matrix is calculated according to expression (17), the difference Δs of pitch scales per point is read from the pitch-scale interpolation unit 8, and the pitch scale of the next pitch waveform is calculated as:

$$s'=s+N_p(s)\Delta s.$$

Using this value of s', $$w'(0) = C(s') \sum_{m=0}^{M-1} p(m) \sum_{l=1}^{[N_p(f)/2]} \cos(ml\theta)$$

$$\gamma_0 = w'(0)/w(0)$$
$$\gamma(k) = 1 + (\gamma_0 - 1)/N_p(s) \cdot k \ (0 \leqq k < N_p(s))$$

are calculated, and $$w(k)=\Gamma(k)w(k)$$

is made to be the pitch waveform.

FIG. 11 is a diagram illustrating connection of the generated pitch waveforms. If a speech waveform output from the waveform generation unit 9 as a synthesized speech is expressed by:

W(n) ($0 \leqq n$), connection of pitch waveforms is performed according to $$W(n_w+k)=w(k) \ (i=0, \ 0 \leqq k < N_p(s))$$

$$W\left(\sum_{j=0}^{i-1} N_j + n_w + k\right) = w(k) \ (i > 0, \ 0 \leqq k < N_p(s)),$$

where $N_j$ is the frame time length of the j-th frame.

The processing performed in steps S13, S14, S15, S16 and S17 is the same as that in the first embodiment.

Eighth Embodiment

In an eighth embodiment of the present invention, a description will be provided of a case in which a pitch waveform for a half period is used instead of a pitch waveform for one period utilizing the symmetery of pitch waveforms.

As in the case of the first embodiment, FIGS. 25 and 1 are block diagrams illustrating the configuration and the functional configuration of a speech synthesis apparatus according to the eighth embodiment, respectively.

A description will now be provided of the generation of pitch waveforms by the waveform generation unit 9.

Synthesis parameters used for generating pitch waveforms are expressed by p(m) ($0 \leqq m < M$). If the sampling frequency is represented by $f_s$, the sampling period is expressed by:

$$T_s=1/f_s.$$

If the pitch frequency of synthesized speech is represented by f, the pitch period is expressed by:

$$T=1/f,$$

and the number of pitch period points is expressed by:

$$N_p(f)=f_sT=T/T_s=f_s/f.$$

The number of pitch period points quantized by an integer is expressed by:

$$N_p(f)=[f_s/f],$$

where [x] is the maximum integer equal to or less than x.

An angle θ for each point when the number of pitch period points is made to correspond to an angle 2π is expressed by:

$$\theta=2\pi/N_p(f).$$

The values of spectrum envelopes at integer multiples of the pitch frequency are expressed by:

$$e(l)=\sum_{m=0}^{M-1} p(m)\cos(ml\theta)\ (1 \leqq l \leqq [N_p(f)/2]).$$

If the half-period pitch waveforms are expressed by:

$$w(k)\ (0 \leqq k < [N_p(f)/2]),$$

a power-normalized coefficient corresponding to the pitch frequency f is given by:

$$C(f)=\sqrt{f/f_0}\ ,$$

where $f_0$ is the pitch frequency at which C(f)=1.0.

By superposing sine waves of interger multiples of the fundamental frequency, the half-period pitch waveforms w(k) ($0 \leqq k \leqq N_p(f)/2$) are generated as:

$$w(k)=C(f)\sum_{l=1}^{[N_p(f)/2]} e(l)\sin(lk\theta) \tag{18}$$

$$w(k)=C(f)\sum_{l=1}^{[N_p(f)/2]} \sin(lk\theta)\sum_{m=0}^{M-1} p(m)\cos(ml\theta)$$

$$w(k)=C(f)\sum_{m=0}^{M-1} p(m)\sum_{l=1}^{[N_p(f)/2]} \sin(lk\theta)\cos(ml\theta).$$

In this embodiment all summations over 1 are taken from 1=1 to 1=[$N_p$(f)/2].

Alternatively, by superposing sine waves of interger multiples of the fundamental frequency while shifting them by half the phase of the pitch period, the half-period pitch waveforms w(k) ($0 \leqq k \leqq N_p(f)/2$) are generated as:

$$w(k)=C(f)\sum_{l=1}^{[N_p(f)/2]} e(l)\sin(l(k\theta+\pi)) \tag{19}$$

$$w(k)=C(f)\sum_{l=1}^{[N_p(f)/2]} \sin(l(k\theta+\pi))\sum_{m=0}^{M-1} p(m)\cos(ml\theta)$$

$$w(k)=C(f)\sum_{m=0}^{M-1} p(m)\sum_{l=1}^{[N_p(f)/2]} \sin(l(k\theta+\pi))\cos(ml\theta).$$

A pitch scale is used as a scale for representing the pitch of speech. Instead of directly performing the calculation of expressions (18) and (19), the speed of calculation can be increased in the following manner. That is, if the number of pitch period points corresponding to a pitch scale s are represented by $N_p(s)$, and $\theta=2\pi N_p(s)$, $$c_{km}(s)=\sum_{l=1}^{[N_p(f)/2]} \sin(lk\theta)\cos(ml\theta)$$

for expression (18), and $$c_{km}(s)=\sum_{l=1}^{[N_p(f)/2]} \sin(l(k\theta+\pi)\cos(ml\theta)$$

for expression (19) are calculated, and the results of the calculation are stored in a table. A waveform generation matrix is expressed as:

$$WGM(s)=(c_{km}(s))\ (0 \leqq k \leqq [N_p(s)/2],\ 0 \leqq m < M).$$

The number of pitch period points $N_p(s)$ and the power-normalized coefficients C(s) corresponding to the pitch scale s are also stored in the table.

The waveform generation unit 9 reads the number of pitch period points $N_p(s)$, the power-normalized coefficient C(s) and the waveform generation matrix WGM(s)=($c_{km}$(s)) from the table while using the synthesis parameters p(m) ($0 \leqq m < M$) output from the synthesis-parameter interpolation unit 7 and the pitch scale s output from the pitch-scale interpolation unit 8 as inputs, and generates half-period pitch waveforms according to:

$$w(k)=C(s)\sum_{m=0}^{M-1} c_{km}(s)p(m)\ (0 \leqq k \leqq [N_p(s)/2])).$$

The above-described operation will be described with reference to the flowchart shown in FIG. 7.

The processing of steps S1, S2, S3, S4, S5, S6, S7, S8, S9, S10 and S11 is the same as in the first embodiment.

In step S12, the waveform generation unit 9 generates half-period pitch waveforms using the synthesis parameters p[m] ($0 \leqq m < M$) obtained from expression (3) and the pitch scale s obtained from expression (4). The number of pitch period points $N_p(s)$, the power-normalized coefficient C(s) and the waveform generation matrix WGM(s)=($c_{km}$(s)) ($0 \leqq k < [N_p(s)/2]$, $0 \leqq m < M$) corresponding to the pitch scale s are read from the table, and the half-period pitch waveforms are generated using the following expression:

$$w(k)=C(s)\sum_{m=0}^{M-1} c_{km}(s)p(m)\ (0 \leqq k \leqq [N_p(s)/2]).$$

A description will now be provided of connection of the generated half-period pitch waveforms. If a speech waveform output from the waveform generation unit 9 as a synthesized speech is expressed by:

W(n) ($0 \leqq n$), the connection of the pitch waveforms is performed according to $$\begin{cases} W(n_w+k)=w(k) & \text{when } (i=0,\ 0 \leqq k \leqq [N_p(s)/2]) \\ W\left(\sum_{j=0}^{i-1} N_j+n_w+k\right)=w(k) & \text{when } (i>0,\ 0 \leqq k \leqq [N_p(s)/2]) \end{cases}$$

$$\begin{cases} W(n_w+k)=-w(N_p(s)-k) & \text{when } (i=0,\ [N_p(s)/2]<k<N_p(s)) \\ W\left(\sum_{j=0}^{i-1} N_j+n_w+k\right)=-w(N_p(s)-k) & \text{when } (i>0,\ [N_p(s)/2]<k<N_p(s)), \end{cases}$$

where $N_j$ is the frame time length of the j-th frame.

The processing performed in steps S13, S14, S15, S16 and S17 is the same as that in the first embodiment.

Ninth Embodiment

In a ninth embodiment of the present invention, a description will be provided of a case in which the pitch waveform is symmetrical for a pitch waveform whose number of pitch period points has a decimal-point portion.

As in the case of the first embodiment, FIGS. 25 and 1 are block diagrams illustrating the configuration and the functional configuration of a speech synthesis apparatus according to the ninth embodiment, respectively.

A description will now be provided of the generation of pitch waveforms by the waveform generation unit 9 with reference to FIGS. 24A–24D.

Synthesis parameters used for generating pitch waveforms are expressed by p(m) ($0 \leqq m < M$). If the sampling frequency is expressed by $f_s$, the sampling period is expressed by:

$$T_s=1/f_s.$$

If the pitch frequency of synthesized speech is represented by f, the pitch period is expressed by:

$$T=1/f,$$

and the number of pitch period points is expressed by:

$$N_p(f)=f_s T=T/T_s=f_s/f.$$

The decimal portion of the number of pitch period points is expressed by connecting pitch waveforms whose phases are shifted with respect to each other. The number of pitch waveforms corresponding to the frequency f is expressed by a phase number $n_p(f)$. FIGS. 24A–24D illustrate pitch waveforms when $n_p(f)=3$. In addition, the number of expanded pitch period points is expressed by:

$$N(f)=[n_p(f)]N_p(f)]=[n_p(f)f_s/f],$$

where [x] represents the maximum integer equal to or less than x, and the number of pitch period points is quantized as:

$$N_p(f)=N(f)/n_p(f).$$

An angle $\theta_1$ for each point when the number of pitch period points is made to correspond to an angle $2\pi$ is expressed by:

$$\theta_1=2\pi/N_p(f).$$

The values of spectrum envelopes at integer multiples of the pitch frequency are expressed by:

$$e(l)=\sum_{m=0}^{M-1} p(m)\cos(ml\theta_1)\ (1 \leqq l \leqq [N_p(f)/2]).$$

An angle $\theta_2$ for each point when the number of expanded pitch period points is made to correspond to $2\pi$ is expressed by:

$$\theta_2=2\pi/N(f).$$

The number of expanded pitch waveform points is expressed by $$N_{ex}(f)=[[(n_p(f)+1)/2]N(f)/n_p(f)]-[1-([(n_p(f)+1)N(f))\bmod n_p(f)/n_p(f)]+1,$$

where a mod b indicates a remainder obtained when a is divided by b.

If the expanded pitch waveforms are expressed by:

$w(k)\ (0 \leqq k<N_{ex}(f))$, a power-normalized coefficient corresponding to the pitch frequency f is given by:

$$C(f)=\sqrt{f/f_0},$$

where $f_0$ is the pitch frequency at which C(f)=1.0.

By superposing sine waves of interger multiples of the pitch frequency, the expanded pitch waveforms w(k) $(0 \leqq k<N_{ex}(f))$ are generated as:

$$w(k)=C(f)\sum_{l=1}^{[N_p(f)/2]} e(l)\sin(lkn_p(f)\theta_2) \tag{20}$$

$$w(k)=C(f)\sum_{l=1}^{[N_p(f)/2]} \sin(lkn_p(f)\theta_2)\sum_{m=0}^{M-1} p(m)\cos(ml\theta_1)$$

-continued $$w(k)=C(f)\sum_{m=0}^{m-1} p(m)\sum_{l=1}^{[N_p(f)/2]} \sin(lkn_p(f)\theta_2)\cos(ml\theta_1).$$

Alternatively, by superposing sine waves of interger multiples of the fundamental frequency while shifting them by half the phase of the pitch period, the expanded pitch waveforms w(k) $(0 \leqq k<N_{ex}(f))$ are generated as:

$$w(k)=C(f)\sum_{l=1}^{[N_p(f)/2]} e(l)\sin(l(kn_p(f)\theta_2+\pi)) \tag{21}$$

$$w(k)=C(f)\sum_{l=1}^{[N_p(f)/2]} \sin(l(kn_p(f)\theta_2+\pi))\sum_{m=0}^{M-1} p(m)\cos(ml\theta_1)$$

$$w(k)=C(f)\sum_{m=0}^{M-1} p(m)\sum_{l=1}^{[N_p(f)/2]} \sin(l(kn_p(f)\theta_2+\pi))\cos(ml\theta_1).$$

In the above equations in this embodiment 1is summed from 1 to $[N_p(f)/2]$.

A phase index is represented by:

$i_p(0 \leqq i_p<n_p(f))$.

A phase angle corresponding to the pitch frequency f and the phase index $i_p$ is defined as:

$$\phi(f,i_p)=(2\pi/n_p(f))i_p.$$

The following definition is made:

$$r(f,i_p)=i_p N(f)\bmod n_p(f).$$

The number of pitch waveform points of the pitch waveform corresponding to the phase index $i_p$ is calculated by the following expression:

$$P(f,i_p)=[(i_p+1)N(f)/n_p(f)]-[1-r(f,i_p+1)/n_p(f)]-[i_p N(f)/n_p(f)]+[1-r(f,i_p)/n_p(f)].$$

The pitch waveform corresponding to the phase index $i_p$ is expressed by:

$$w_p(k)=\begin{cases} w(k) & \text{when } (i_p=0,\ 0 \leqq k \leqq P(f,i_p)) \\ w\left(\sum_{j=0}^{i_p-1} P(f,j)+k\right) & \text{when } (0<i_p<[(n_p(f)+1)/2],\ 0<k<P(f,i_p)) \\ -w\left(\sum_{j=0}^{n_p(f)-i-1} P(f,j)-1-k\right) & \text{when } ([(n_p(f)+1)/2] \leqq i_p<n_p(f),\ 0 \leqq k<P(f,i_p)) \end{cases}$$

Thereafter, the phase index is updated as:

$$i_p=(i_p+1)\bmod n_p(f),$$

and the phase angle is calculated using the updated phase index as:

$$\phi_p=\phi(f,i_p).$$

When the pitch frequency is changed to f' when generating the next pitch waveform, in order to obtain the phase angle nearest to the phase angle $\phi_p$, i' satisfying the following expression is obtained:

$$|\phi(f,i')-\phi_p| = \min_{0 \leqq i < n_p(f')} |\phi(f',i)-\phi_p|,$$

and $i_p$ is determined so that $i_p=i'$.

Figure 24A:
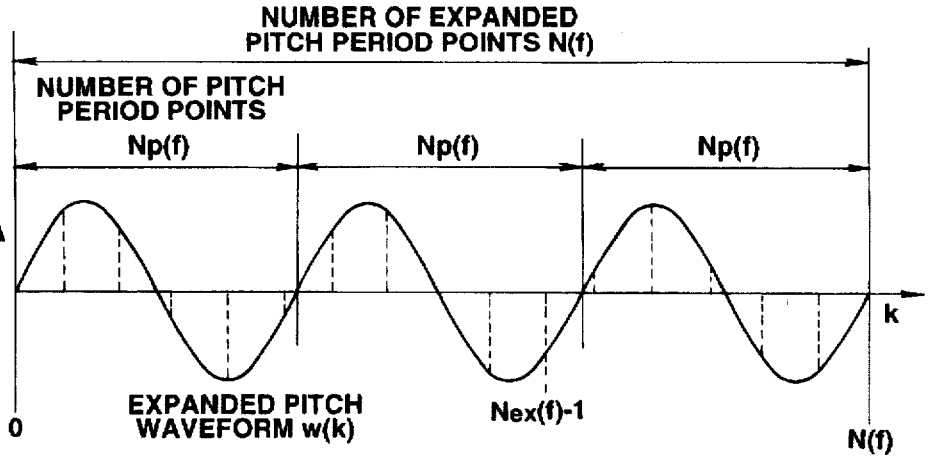
FIGS. 24A–24D are graphs illustrating pitch waveforms.
Figure 24B:
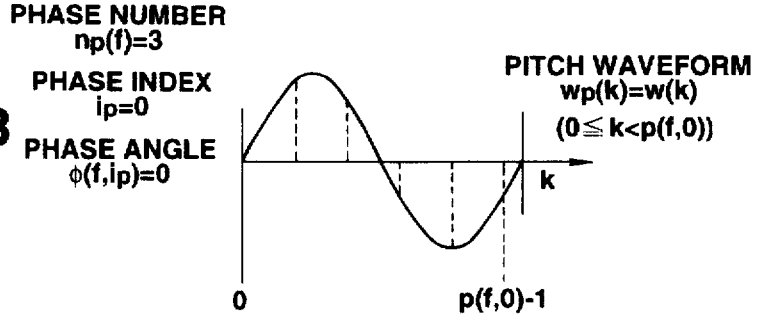
Figure 24C:
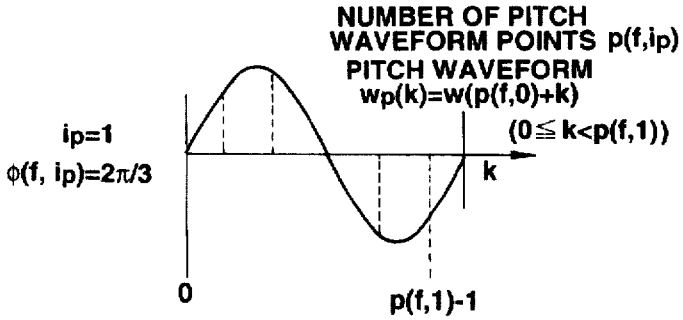
Figure 24D:
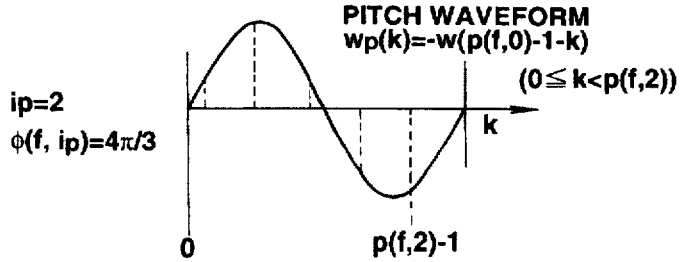

Thus, FIG. 24A shows the expanded pitch waveform w(k), the number of pitch period points $N_p(f)$, the number of expanded pitch period points N(f), and the number of expanded pitch waveform points $N_{ex}(f)-1$. FIG. 24B shows the pitch waveform corresponding to the phase index $i_p$, $w_p(k)=w(k)$ when $0 \leqq k \leqq P(f,0)$, when the phase index is 0, and when the phase angle, $\phi(f,i_p)$ is zero and the phase number $n_p(f)$ is 3, and FIG. 24B also shows the number of pitch waveform points $P(f,i_p)$ and $P(f,0)-1$. FIG. 24C shows a pitch waveform when the phase index is 1 and the phase angle $\phi(f,i_p)$ is $2\pi/3$, so that the pitch waveform is $w_p(k)=w(P(f,0)+k)$ when $0 \leqq k < P(f,1)$, and the number of pitch waveform points minus 1 is $P(f,1)-1$. FIG. 24D shows a pitch waveform when the phase index is 2 and the phase angle $\phi(f,i_p)$ is $4\pi/3$, so the pitch waveform is $w_p(k)=w(P(f,0)-1-k)$ when $0 \leqq k < P(f,2)$ and the number of pitch waveform points minus 1 is $P(f,2)-1$.

A pitch scale is used as a scale for representing the pitch of speech. Instead of directly performing the calculation of expressions (20) and (21), the speed of calculation can be increased in the following manner. That is, if the phase number, the phase index, the number of expanded pitch period points, the number of pitch period points, and the number of pitch waveform points corresponding to a pitch scale $s \in S$ (S being a set of pitch scales) are represented by $n_p(s)$, $i_p(0 \leqq i_p < n_p(s))$, N(s), $N_p(s)$, and $P(s,i_p)$, respectively, and $$\theta_1 = 2\pi/N_p(s)$$
$$\theta_2 = 2\pi/N(s),$$

$$c_{km}(s,i_p) = \begin{cases} \sum_{l=1}^{[N_p(f)/2]} \sin((lkn_p(s)\theta_2)\cos(ml\theta_1) & \text{when } (i_p=0) \\ \sum_{l=1}^{[N_p(f)/2]} \sin\left(\left(l\left(\sum_{j=0}^{i_p-1} P(s,j)+k\right)n_p(s)\theta_2\right)\right)\cos(ml\theta_1) & \text{when } (0<i_p<[(n_p(s)+1)/2]), \end{cases}$$

where l is summed from 1 to $[N_p(s)/2]$, for expression (20), and $$c_{km}(s,i_p) = \begin{cases} \sum_{l=1}^{[N_p(f)/2]} \sin(l(kn_p(s)\theta_2+\pi))\cos(ml\theta_1) & \text{when } (i_p=0) \\ \sum_{l=1}^{[N_p(f)/2]} \sin\left(l\left(\left(\sum_{j=0}^{i_p-1} P(s,j)+k\right)n_p(s)\theta_2+\pi\right)\right)\cos(ml\theta_1) & \text{when } (0<i_p<[(n_p(s)+1)/2]), \end{cases}$$

where l is summed from 1 to $[N_p(s)/2]$, for expression (21) are calculated, and the results of the calculation are stored in a table. A waveform generation matrix is expressed as:

$$WGM(s,i_p)=(c_{km}(s,i_p)) \ (0 \leqq k < P(s,i_p),\ 0 \leqq m < M).$$

The phase angle $\phi(s,i_p)=(2\pi/n_p(s))i_p$ corresponding to the pitch scale s and the phase index $i_p$ is also stored in the table. In addition, the correspondence relationship for providing $i_0$ which satisfies $$|\phi(s,i_0)-\phi_p| = \min_{0 \leqq i < n_p(s)} |\phi(s,i)-\phi_p|$$

for the pitch scale s and the phase angle $\phi_p(\in\{\phi(s,i_p)|s \in S,\ 0 \leqq i < n_p(s)\})$ is expressed by:

$$i_0=I(s,\phi_p),$$

and is stored in the table. The phase number $n_p(s)$, the number of pitch waveform points $P(s,i_p)$, and the power-normalized coefficient C(s) corresponding to the pitch scale s and the phase index $i_p$ are also stored in the table.

The waveform generation unit 9 determines a phase index $i_p$ stored in an internal register by:

$$i_p=I(s,\phi_p),$$

where $\phi_p$ is the phase angle, and reads the number of pitch waveform points $P(s,i_p)$, and the power-normalized coefficient C(s) from the table while using the synthesis parameters p(m) $(0 \leqq m < M)$ output from the synthesis-parameter interpolation unit 7 and the pitch scale s output from the pitch-scale interpolation unit 8 as inputs. Then, when $0 \leqq i_p < [(n_p(s)+1)/2]$, the waveform generation unit 9 reads the waveform generation matrix $WGM(s,i_p)=(c_{km}(s,i_p))$ from the table, and generates pitch waveforms according to:

$$w_p(k) = C(k)\sum_{m=0}^{M-1} c_{km}(s,i_p)p(m) \ (0 \leqq k < N_p(s,i_p)).$$

When $[(n_p(s)+1)/2] \leqq i_p < n_p(s)$, the waveform generation unit 9 reads the waveform generation matrix $WGM(s,i_p)=(c_{k'm}(s,n_p(s)-1-i_p))$, where $k'=P(s,n_p(s)-1-i_p)-1-k(0 \leqq k < P(s,i_p))$, from the table, and generates the pitch waveforms according to:

$$w_p(k) = -C(s)\sum_{m=0}^{M-1} c_{k'm}(s,n_p(s-1-i_p)p(m)$$
$$(0 \leqq k < P(s,i_p)).$$

After generating the pitch waveforms, the phase index is updated as:

$$i_p=(i_p+1)\bmod n_p(s),$$

and updates the phase angle using the updated phase index as:

$$\phi_p=\phi(s,i_p).$$

The above-described operation will now be explained with reference to the flowchart shown in FIG. 13.

The processing performed in steps S201, S202, S203, S204, S205, S206, S207, S208, S209, S210, S211, S212 and S213 is the same as in the second embodiment.

In step S214, the waveform generation unit 9 generates pitch waveforms using the synthesis parameters p[m]

($0 \leqq m < M$) obtained from expression (3) and the pitch scale s obtained from expression (4). The number of pitch waveform points $P(s,i_p)$ and the power-normalized coefficient C(s) corresponding to the pitch scale s are read from the table. Then, when $0 \leqq i_p < [(n_p(s)+1)/2]$, the waveform generation unit 9 reads the waveform generation matrix WGM $(s,i_p)=(c_{km}(s,i_p))$ from the table, and generates the pitch waveforms according to the following expression:

$$w_p(k) = C(s) \sum_{m=0}^{M-1} c_{km}(s,i_p)p(m) \ (0 \leqq k < P(s,i_p).$$

When $[(n_p(s)+1)/2] \leqq i_p < n_p(s)$, the waveform generation unit 9 reads the waveform generation matrix $WGM(s,i_p)=C_{k'm}(s, n_p(s)-1-i_p)$, where $k'=P(s,n_p(s)-1-i_p)-1-k(0 \leqq k < P(s,i_p))$, from the table, and generates the pitch waveform according to the following expression:

$$w_p(k) = -C(s) \sum_{m=0}^{M-1} c_{k'm}(s,n_p(s)-1-i_p)p(m)$$

$$(0 \leqq k < P(s,i_p)).$$

If a speech waveform output from the waveform generation unit 9 as synthesized speech is expressed by:

$W(n)$ $(0 \leqq n)$, the connection of the pitch waveforms is performed, as in the first embodiment, according to:

$$W(n_w + k) = w_p(k) \ (i = 0, 0 \leqq k < P(s,i_p))$$

$$W\left(\sum_{j=0}^{i-1} N_j + n_w + k\right) = w_p(k) \ (i > 0, 0 \leqq k < P(s,i_p)),$$

where $N_j$ is the frame time of the j-th frame.

The processing performed in steps S215, S216, S217, S218, S219 and S220 is the same as in the second embodiment.

The individual components designated by blocks in the drawings are all well known in the speech synthesis method and apparatus arts and their specific construction and operation are not critical to the operation or the best mode for carrying out the invention.

While the present invention has been described with respect to what is presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A speech synthesis apparatus for synthesizing speech from a character series comprising a text and pitch information input into the apparatus, said apparatus comprising:

input means for inputting the character series comprising the text and control information including the pitch information;

parameter generation means for generating a parameter series of power spectrum envelopes of a speech waveform to be synthesized representing the input text in accordance with the input character series input by said input means;

parameter storage means for storing a parameter series of a frame to be processed generated by said parameter generation means;

frame-time-length setting means for calculating the time length of each frame from the control information and text input by said input means;

waveform-point-number storage means, connected to said frame-time-length setting means, for calculating and storing the number of waveform points of one frame;

synthesis-parameter interpolation means for interpolating synthesis parameters from the parameter series stored in said parameter storage means in accordance with the frame time length set by said frame-time-length setting means and the number of waveform points stored in said waveform-point-number storage means;

pitch waveform generation means for generating pitch waveforms, whose period equals the pitch period specified by the input pitch information, said pitch waveform generation means generating the pitch waveforms from the pitch information input by said input means and the power spectrum envelopes generated as the parameter series of the speech waveform by said parameter generation means, said pitch waveform generation means comprising pitch scale interpolation means for interpolating pitch scales using pitch scales received from said parameter storage means, the frame time length set by said frame-time length setting means, and the number of waveform points stored in said waveform-point-number storage means; and speech waveform output means for generating pitch waveforms using the synthesis parameters interpolated by said synthesis parameter interpolation means and the interpolated pitch scales interpolated by said pitch scale interpolation means and for outputting the speech waveform by connecting the generated pitch waveforms.

2. An apparatus according to claim 1, wherein said pitch waveform generation means further comprises matrix derivation means for deriving a matrix for converting the power spectrum envelopes into the pitch waveforms, and wherein said pitch waveform generation means generates the pitch waveforms by obtaining a product of the derived matrix and the power spectrum envelopes.

3. An apparatus according to claim 1, wherein the text comprises a phonetic text, wherein said apparatus is adapted to receive speech information comprising the character series, wherein the character series comprises the phonetic text represented by the speech waveform and control data, the control data including the pitch information and specifying characteristics of the speech waveform, said apparatus further comprising means for identifying when the phonetic text and the control data are input as the speech information, wherein the parameter generation means generates the parameters in accordance with the speech information identified by said identification means.

4. An apparatus according to claim 1, further comprising a speaker for outputting the speech waveform output from said speech waveform output means as synthesized speech.

5. An apparatus according to claim 1, further comprising a keyboard for inputting the character series.

6. A speech synthesis apparatus for synthesizing speech from a character series comprising a text and pitch information input into the apparatus, said apparatus comprising:

input means for inputting the character series comprising the text and control information including the pitch information;

parameter generation means for generating a parameter series of power spectrum envelopes of a speech waveform to be synthesized representing the input text in accordance with the input character series input by said input means;

parameter storage means for storing a parameter series of a frame to be processed generated by said parameter generation means;

frame-time-length setting means for calculating the time length of each frame from the control information and text input by said input means;

waveform-point-number storage means, connected to said frame-time-length setting means, for calculating and storing the number of waveforms points of one frame;

synthesis-parameter interpolation means for interpolating synthesis parameters from the parameter series stored in said parameter storage means in accordance with the frame time length set by said frame-time-length setting means and the number of waveform points stored is said waveform-point-number storage means;

pitch waveform generation means for generating pitch waveforms from a sum of products of the parameter series and a cosine series, whose coefficients relate to the input pitch information and sampled values of the power spectrum envelopes generated as the parameter series, said pitch waveform generation means comprising pitch scale interpolation means for interpolating pitch scales using pitch scales received from said parameter storage means, the frame time length set by said frame-time length setting means, and the number of waveform points stored in said waveform-point-number storage means;and speech waveform output means for generating pitch waveforms using the synthesis parameters interpolated by said means and the interpolated pitch scales interpolated by said pitch scale interpolation means and for outputting the speech waveform by connecting the generated pitch waveforms.

7. An apparatus according to claim 6, wherein said pitch waveform generation means generates pitch waveforms whose period equals a pitch period of the speech waveform output by said speech waveform output means.

8. An apparatus according to claim 6, wherein said pitch waveform generation means calculates the sum of products while shifting the phase of the cosine series by half a period.

9. An apparatus according to claim 6, wherein said pitch waveform generation means further comprises matrix derivation means for deriving a matrix for each pitch by computing a sum of products of cosine functions whose coefficients comprise impulse-response waveforms obtained from logarithmic power spectrum envelopes of the speech to be synthesized, and cosine functions whose coefficients comprise sampled values of the spectrum envelopes, wherein said pitch waveform generation means generates the pitch waveforms by obtaining the product of the derived matrix and the impulse-response waveforms.

10. An apparatus according to claim 6, wherein the text comprises a phonetic text, wherein said apparatus is adapted to receive speech information comprising the character series, wherein the character series comprises the phonetic text and control data, the control data including the pitch information and specifying characteristics of the speech waveform, said apparatus further comprising means for identifying when the phonetic text and the control data are input as the speech information, wherein said parameter generation means generates the parameters in accordance with the speech information identified by said identification means.

11. An apparatus according to claim 6, further comprising a speaker for outputting the speech waveform output from said speech waveform output means as a synthesized speech.

12. An apparatus according to claim 6, further comprising a keyboard for inputting the character series.

13. A speech synthesis method for synthesizing speech from a character series comprising a text and pitch information comprising the steps of:

inputting the character series comprising the text and control information including the pitch information with input means;

generating a parameter series of power spectrum envelopes of a speech waveform to be synthesized representing the text in accordance with the character series input by the input means in said inputting step;

storing a parameter series of a frame to be processed generated by said parameter series generating step;

calculating and setting the time length of each frame from the control information and text input by said inputting step;

calculating and storing the number of waveform points of one frame in accordance with the frame time length calculated and set in said time length calculating and setting step;

interpolating synthesis parameters from the parameter series stored in said parameter storing step in accordance with the frame time length set by said frame-time-length calculating and setting step and the number of waveform points stored in said waveform-point-number calculating and storing step;

generating pitch waveforms, whose period equals the pitch period specified by the pitch information, from the pitch information input in said inputting step and the power spectrum envelopes generated as the parameters in said power spectrum envelope generating step, said pitch waveform generating step comprising a Pitch scale interpolation step for interpolating pitch scales using pitch scales stored in said parameter storing step, the frame time length set by said frame-time length calculating and setting step, and the number of waveform points stored in said waveform-point-number calculating and storing step; and generating pitch waveforms using the synthesis parameters interpolated by said synthesis parameters interpolating step and the interpolated pitch scales interpolated in said pitch scale interpolation step and connecting the generated pitch waveforms to produce the speech waveform.

14. A method according to claim 13, further comprising the steps of:

deriving a matrix for converting the power spectrum envelopes into the pitch waveforms; and generating the pitch waveforms by obtaining a product of the derived matrix and the power spectrum envelopes.

15. A method according to claim 13, wherein the text comprises a phonetic text, wherein the character series comprises the phonetic text, represented by the speech waveform, and control data, the control data including the pitch information and specifying the characteristics of the speech waveform, said method further comprising the steps of:

identifying when the phonetic text and the control data are input as part of the character series; and generating the parameters in accordance with the identification in said identifying step.

16. A method according to claim 13, further comprising the step of outputting the connected pitch waveforms from a speaker as the synthesized speech.

17. A method according to claim 13, further comprising the step of inputting the character series from a keyboard into a speech synthesis apparatus.

18. A speech synthesis method for synthesizing speech from a character series comprising a text and pitch information comprising the steps of:

inputting the character series comprising the text and control information including the pitch information with input means;

generating a parameter series of power spectrum envelopes of a speech waveform to be synthesized and representing the text in accordance with the character series input by the input means in said inputting step;

storing a parameter series of a frame to be processed. generated by said parameter series generating step;

calculating and setting the time length of each frame from the control information and text input by said inputting step;

calculating and storing the number of waveform points of one frame in accordance with the frame time length calculated and set in said time length calculating and setting step:

interpolating synthesis parameters from the parameter series stored in said parameter storing step in accordance with the frame time length set by said frame-time-length calculating and setting step and the number of waveform points stored in said waveform-point-number calculating and storing step;

generating pitch waveforms from a sum of products of the parameter series and a cosine series, whose coefficients relate to the pitch information input in said inputting step and sampled values of the power spectrum envelopes generated as the [parameters] parameter series, said pitch waveform generating step comprising a pitch scale interpolation step for interpolating pitch scales using pitch scales stored in said parameter storing step, the frame time length set by said frame-time length calculating and setting step, and the number of waveform points stored in said waveform-point-number calculating and storing step; and generating pitch waveforms using the synthesis parameters interpolated by said synthesis parameters interpolating step and the interpolated pitch scales interpolated in said pitch scale interpolation step and connecting the generated pitch waveforms to produce the speech waveform.

19. A method according to claim 18, wherein said pitch waveform generating step comprises the step of generating pitch waveforms having a period equal to the pitch period of the speech waveform produced in said connecting step.

20. A method according to claim 18, wherein said pitch waveform generating step calculates the sum of the products while shifting the phase of the cosine series by half a period.

21. A method according to claim 18, further comprising the steps of:

obtaining impulse-response waveforms from logarithmic power spectrum envelopes of the speech to be synthesized;

deriving a matrix by computing a sum of products of a cosine function whose coefficients comprise the impulse-response waveforms and a cosine function whose coefficients comprise sampled values of the spectrum envelopes;

generating the pitch waveforms by calculating a product of the matrix and the impulse-response waveforms.

22. A method according to claim 18, wherein the text comprises a phonetic text, wherein the character series comprises the phonetic text, represented by the speech waveform, and control data, the control data including the pitch information and specifying the characteristics of the speech waveform, said method further comprising the steps of:

identifying when the phonetic text and the control data are input as part of the character series; and generating the parameters in accordance with the identification in said identifying step.

23. A method according to claim 18, further comprising the step of outputting the connected pitch waveforms from a speaker as the synthesized speech.

24. A method according to claim 18, further comprising the step of inputting the character series from a keyboard into a speech synthesis apparatus.

25. A computer usable medium having computer readable program code means embodied therein for causing a computer to synthesize speech from a character series comprising a text and pitch information input into the computer, said computer readable program code means comprising:

first computer readable program code means for causing the computer to input the character series comprising the text and control information including the pitch information;

second computer readable program code means for causing the computer to generate a parameter series of power spectrum envelopes of a speech waveform to be synthesized representing the input text in accordance with the input character series caused to be input by said first computer readable program code means;

third computer readable program code means for causing the computer to store a parameter series of a frame to be processed caused to be generated by said second computer readable program code means;

fourth computer readable program code means for causing the computer to calculate the time length of each frame from the control information and text input by said input means;

fifth computer readable program code means for causing the computer to calculate and store the number of waveform points of one frame;

sixth computer readable program code means for causing the computer to interpolate synthesis parameters from the stored parameter series caused to be stored by said third computer readable program code means in accordance with the frame time length caused to be set by said fourth computer readable program code means and the stored number of waveform points caused to be stored by said fifth computer readable program code means;

seventh computer readable program code means for causing the computer to generate pitch waveforms, whose period equals the pitch period specified by the input pitch information, said seventh computer readable program code means causing the computer to generate pitch waveforms from the pitch information caused to be input by said first computer readable program code means and the power spectrum envelopes caused to be generated as the parameter series of the speech waveform by said second computer readable program code means, said seventh computer readable program code means causing the computer to interpolate pitch scales using the parameter series of the frame caused to be stored by said third computer readable program code means, the set frame time length caused to be set by said fourth computer readable program code means, and the stored number of waveform points caused to be stored by said fifth computer readable program code means; and eighth computer readable program code means for causing the computer to generate pitch waveforms using the interpolated synthesis parameters caused to be interpolated by said sixth computer readable program code means and the interpolated pitch scales caused to be interpolated by said seventh computer readable program code means and for causing the computer to output the speech waveform by connecting the generated pitch waveforms.

26. A computer usable medium having computer readable program code means embodied therein for causing a computer to synthesize speech from a character series comprising a text and pitch information input into the computer, said computer readable program code means comprising:

first computer readable program code means for causing the computer to input the character series comprising the text and control information including the pitch information;

second computer readable program code means for causing the computer to generate a parameter series of power spectrum envelopes of a speech waveform to be synthesized representing the input text in accordance with the input character series caused to be input by said first computer readable program code means;

third computer readable program code means for causing the computer to store a parameter series of a frame to be processed caused to be generated by said second computer readable program code means;

fourth computer readable program code means for causing the computer to calculate the time length of each frame from the control information and text input by said input means;

fifth computer readable program code means for causing the computer to calculate and store the number of waveform points of one frame;

sixth computer readable program code means for causing the computer to interpolate synthesis parameters from the stored parameter series caused to be stored by said third computer readable program code means in accordance with the frame time length caused to be set by said fourth computer readable program code means and the stored number of waveform points caused to be stored by said fifth computer readable program code means;

seventh computer readable program code means for causing the computer to generate pitch waveforms from a sum of products of the parameter series and a cosine series, whose coefficients relate to the input pitch information and sampled values of the power spectrum envelopes generated as the parameter series, said seventh computer readable program code means causing the computer to interpolate pitch scales using the stored parameter series of a frame caused to be stored by said third computer readable program code means, the set frame time length caused to be set by fourth computer readable program code means, and the stored number of waveform points caused to be stored by said fifth computer readable program code means; and eighth computer readable program code means for causing the computer to generate pitch waveforms using the interpolated synthesis parameters caused to be interpolated by said sixth computer readable program code means and the interpolated pitch scales caused to be interpolated by said seventh computer readable program code means and for causing the computer to output the speech waveform by connecting the generated pitch waveforms.

* * * * *

UNITED STATES PATENT AND TRADEMARK OFFICE

CERTIFICATE OF CORRECTION

PATENT NO. : 5,745,650

DATED : April 28, 1998

INVENTORS : MITSURU OTSUKA, ET AL.

It is certified that error appears in the above-identified patent and that said Letters Patent is hereby corrected as shown below:

COLUMN 1,
Line 9, "according" should read --according to--.

COLUMN 2,
Line 65, "parameters" should read --parameters and--.

COLUMN 6,
Line 51, "nw" should read --$n_w$--.
Line 56, "nw" should read --$n_w$--.

COLUMN 9,
Line 47, "S10," should read --S10,--.

COLUMN 13,
Line 1, "$\phi_p$=$\phi$f),ip), "should read --$\phi_p$=$\phi$(f,$i_p$),--.

UNITED STATES PATENT AND TRADEMARK OFFICE

CERTIFICATE OF CORRECTION

PATENT NO. : 5,745,650

DATED : April 28, 1998

INVENTORS : MITSURU OTSUKA, ET AL.

It is certified that error appears in the above-identified patent and that said Letters Patent is hereby corrected as shown below:

COLUMN 13,
Lines 25-45, "$[N_p(f)/2]$" (each occurrence) should read --$[n_p(s)/2]$--.

COLUMN 16,
Line 56, "nw" should read --$n_w$--.
Line 61, "nw" should read --$n_w$--.

COLUMN 19,
Line 27, "nw" should read --$n_w$--.

COLUMN 20,
Line 5, "$n_w \geq N_i$in" should read --$n_w \geq N_i$ in--.

COLUMN 22,
Line 21, "$(S)=(C_{km}(S))$" should read --$(S)=(c_{km}(S))$--.

COLUMN 23,
Lines 51-54, "$b_{mn}=$" should read --If $b_{mn}=$--.

COLUMN 25,
Line 32, "$WGM(s)=(C_{km}(s))$" should read --$WGM(s)=(c_{km}(s))$--.

COLUMN 27,
Line 48, "interger" should read --integer--.

COLUMN 29,
Line 65, "interger" should read --integer--.

UNITED STATES PATENT AND TRADEMARK OFFICE

CERTIFICATE OF CORRECTION

PATENT NO. : 5,745,650

DATED : April 28, 1998

INVENTORS : MITSURU OTSUKA, ET AL.

It is certified that error appears in the above-identified patent and that said Letters Patent is hereby corrected as shown below:

COLUMN 30,
Line 37, "multipled" should read --multiplied--.
Line 40, "interger" should read --integer--.

COLUMN 33,
Line 14, "interger" should read --integer--.
Lines 49-56, "$[N_p(f)/2]$" (each occurrence) should read --$[N_p(s)/2]$--.

COLUMN 35,
Line 57, "interger" should read --integer--.

COLUMN 36,
Line 5, "interger" should read --integer--.
Line 20, "1is" should read --1 is--.

COLUMN 37,
Lines 37-45 and 48-59, "$[N_p(f)/2]$" (each occurrence) should read --$[N_p(s)/2]$--.

UNITED STATES PATENT AND TRADEMARK OFFICE

CERTIFICATE OF CORRECTION

PATENT NO. : 5,745,650

DATED : April 28, 1998

INVENTORS : MITSURU OTSUKA, ET AL.

It is certified that error appears in the above-identified patent and that said Letters Patent is hereby corrected as shown below:

COLUMN 41,
Line 9, "waveforms" should read --waveform--.
Line 14, "is" should read --in--.

COLUMN 42,
Line 34, ""Pitch" should read --pitch--.

Signed and Sealed this

Thirty-first Day of August, 1999

*Attest:*

Q. TODD DICKINSON

*Attesting Officer*

*Acting Commissioner of Patents and Trademarks*